US006607653B1

(12) United States Patent
Tsuji et al.

(10) Patent No.: US 6,607,653 B1
(45) Date of Patent: Aug. 19, 2003

(54) PLATING BATH AND PROCESS FOR DEPOSITING ALLOY CONTAINING TIN AND COPPER

(75) Inventors: Kiyotaka Tsuji, Kobe (JP); Keigo Obata, Akashi (JP); Takao Takeuchi, Akashi (JP); Hidemi Nawafune, Takatsuki (JP); Tetsuji Nishikawa, Kobe (JP)

(73) Assignees: Daiwa Fine Chemicals Co., Ltd., Akashi (JP); Ishihara Chemical Co., Ltd., Kobe (JP)

( * ) Notice: Subject to any disclaimer, the term of this patent is extended or adjusted under 35 U.S.C. 154(b) by 0 days.

(21) Appl. No.: 09/667,715

(22) Filed: Sep. 22, 2000

(30) Foreign Application Priority Data

Sep. 27, 1999 (JP) ..... 11-271770
Sep. 5, 2000 (JP) ..... 2000-268551

(51) Int. Cl.[7] ..... C25D 3/58
(52) U.S. Cl. ..... 205/241; 205/253
(58) Field of Search ..... 205/241, 50, 253, 205/254; 106/1.23

(56) References Cited

U.S. PATENT DOCUMENTS 2,849,352 A * 8/1958 Kirstahler et al. ..... 205/240
2,910,413 A * 10/1959 Strauss et al. ..... 205/240
4,389,286 A * 6/1983 McCoy ..... 205/241
5,156,729 A * 10/1992 Mahrus et al. ..... 205/104
5,759,381 A * 6/1998 Sakurai et al. ..... 205/253
5,948,235 A * 9/1999 Arai ..... 205/252
5,972,192 A * 10/1999 Dubin et al. ..... 205/101
6,183,545 B1 * 2/2001 Okuhama et al. ..... 106/1.22

FOREIGN PATENT DOCUMENTS

| | | |
|---|---|---|
| EP | 1 001 054 | 5/2000 |
| JP | 8-13185 | 1/1996 |
| JP | 9-143786 | 6/1997 |

* cited by examiner

*Primary Examiner*—Roy King
*Assistant Examiner*—William T. Leader
(74) *Attorney, Agent, or Firm*—Armstrong, Westerman & Hattori, LLP

(57) ABSTRACT

The present invention provides a tin-copper alloy plating bath, tin-copper-bismuth alloy plating bath or tin-copper-silver alloy plating bath containing a soluble metal compound and a specific sulfur-containing compound. The plating bath of the present invention is an alloy plating bath containing tin and copper, the bath being capable of preventing deposition of copper on a tin anode by substitution, having low dependence of plated coating composition on current density, high bath stability and resistance to turbidness.

15 Claims, No Drawings

PLATING BATH AND PROCESS FOR DEPOSITING ALLOY CONTAINING TIN AND COPPER

TECHNICAL FIELD

The present invention relates to an alloy plating bath containing tin and copper, method for plating with an alloy containing tin and copper using said plating bath and an article provided with a plated coating by said method.

BACKGROUND ART

In recent years, the concern about the effect of lead on the human body and the environment and about the risk of whisker production by pure tin plating has been increasing the demand for the development of a lead-free solder plating bath.

A tin-silver alloy, a tin-bismuth alloy and the like have been studied as the lead-free solder. However, the plating bath of the tin-silver alloy easily decomposes, and the plated coating of the tin-bismuth alloy is prone to cracks. Therefore, these alloys are disadvantageous.

A tin-copper alloy forms a eutectic composition with a copper content of 1.3 mole %. Although the alloy has a relatively high soldering temperature because of its melting point of 227° C., it is unlikely to form cracks, excellent in soldering strength and less expensive than the tin-silver alloy or the like. For these reasons, the tin-copper alloy is a prospective lead-free solder.

Generally, electroplating with the alloy containing tin and copper is conducted while supplying tin(II) ions in the bath using a tin anode. However, since the copper salts contained in the bath have a standard electrode potential higher than the tin of the anode, chemical substitution occurs between the copper and tin. This may lead to the deposit of metallic copper on the anode. If the copper is deposited on the anode, the copper salt concentration in the bath is lowered and the bath composition changes. Therefore, the resulting plated coating of the tin-copper alloy tends to have inconstant composition. Particularly in the plating bath of the tin-copper alloy, the copper salt concentration in the bath is usually lower than the tin(II) salt concentration, and thus the change in the copper salt concentration greatly affect the composition of the coating.

Further, the composition of the plated coating of a tin-copper alloy, tin-copper-silver alloy, tin-copper-bismuth alloy and like alloys containing tin and copper tends to be dependent on cathodic current density. These alloys have the problem that when plating is carried out at a various current density ranging from high density to low density, the composition of the plated coating varies.

For example, in the tin-copper alloy plating, a tin-copper eutectic alloy having a low melting point can be obtained under the condition of a Cu content of 1.3 mole %. When the composition of the coating varies depending on the current density, it is not possible to constantly obtain the tin-copper alloy plated coating having the composition ratio which is suitable for the application.

Further, the plating bath containing tin and copper is likely to become turbid because of its unstability, unlike a tin plating bath, tin-lead alloy plating bath or the like. For example, the plating bath starts to become slightly turbid about one week after preparation, and the entire plating bath becomes turbid 1 month after the preparation.

The bath becomes turbid because divalent tin salt in the bath is oxidized to be tetravalent, thereby producing colloidal particles of tin oxide hydrate. Even the addition of an antioxidant can not completely prevent the bath from becoming turbid. Therefore, the $Sn^{2+}$ content in the bath may be considerably lowered, which greatly inhibits obtaining a plated coating of an alloy containing tin and copper which has constant composition.

As the plating bath containing tin and copper, for example, Japanese Examined Patent Publication No. 1996-13185 discloses a tin alloy plating bath comprising (a) $Sn^{2+}$ ion, (b) at least one metal ion selected from the group consisting of $Ag^{+}$, $Cu^{2+}$, $In^{3+}$, $Tl^{+}$ and $Zn^{2+}$ and (c) a nonionic surfactant. Example 3 of this publication discloses a tin-copper alloy plating bath containing tin(II) methanesulfonate, copper methanesulfonate, methanesulfonic acid and ethylene oxide adduct of octyl phenol ethoxylate. Example 4 of the same publication discloses a tin-copper alloy plating bath containing tin(II) methanesulfonate, copper methanesulfonate, methanesulfonic acid and ethylene oxide adduct of laurylamine. According to this publication, the effects of these plating baths are that they can provide a low-melting-point plated coating similar to a tin-lead alloy coating without using lead; they impart good appearance and solderability to the plated coating; they facilitate the bath control; etc.

Meanwhile, Japanese Unexamined Patent Publication No. 1997-143786 discloses a silver alloy plating bath comprising (a) $Ag^{+}$ ion; (b) at least one metal ion selected from the group consisting of $Sn^{2+}$, $Cu^{2+}$, $In^{3+}$, $Tl^{+}$, $Zn^{2+}$ and $Bi^{3+}$; (c) thiourea, acetyl thiourea, allylthiourea, trimethylthiourea and like thiourea compounds, thiazole compounds, dithiocarbamate compounds, thioglycol, thioglycolic acid, thiodiglycolic acid, β-thiodiglycol and like sulfur-containing compounds; and (d) a nonion surfactant. Example 5 of the same publication describes a silver-tin-copper alloy plating bath comprising silver methanesulfonate, tin(II) methanesulfonate, copper methanesulfonate, methanesulfonic acid, β-thiodiglycol, sodium N,N'-diethyldithiocarbamate and ethylene oxide adduct of lauryl ether. According to this publication, the effects of the plating bath are that a fine plated coating and high throwing power can be obtained; the bath control is facilitated; etc.

However, the above plating baths disclosed in Nos. 1997-143786 and 1997-143786 have not completely solved the aforementioned problems such as deposition of copper on the anode by substitution, turbidness of the bath, dependence of the coating composition on the current density, etc.

DISCLOSURE OF INVENTION

An primary object of the present invention is to provide a plating bath containing tin and copper, the bath being capable of preventing deposition of copper on a tin anode by substitution, and having low dependence of plated coating composition on current density, high bath stability and resistance to turbidness.

In view of the aforesaid problems of the plating bath containing tin and copper, the inventors of the present invention conducted extensive research and found out that the above object can be achieved by adding a specific sulfur-containing compound to an alloy plating bath containing tin and copper. The present invention was accomplished based on this finding.

The present invention provides the alloy plating bath containing tin and copper and an article provided with a plated coating using the plating bath mentioned in the following.

1. A tin-copper alloy plating bath comprising:

(A) a soluble tin(II) compound;

(B) a soluble copper compound; and (C) at least one sulfur-containing compound selected from the group consisting of the following compounds (i)–(v):

(i) a thiourea compound (ii) a mercaptan compound (iii) an aliphatic sulfide compound represented by the following formula (1):

$$Re—Ra—[(X—Rb)_L—(Y—Rc)_M—(Z—Rd)_N]—Rf \quad (1)$$

(wherein the symbols represent the following:

M is an integer of 1–100, L and N are each 0 or an integer of 1–100; Y represents S or S—S, X and Z are the same or different and each represents O, S or S—S;

Ra represents $C_1$–$C_{12}$ straight-chain or branched-chain alkylene or 2-hydroxypropylene;

Rb, Rc and Rd are the same or different and each represents methylene, ethylene, propylene, 2-hydroxypropylene, butylene, pentylene or hexylene;

in X—Rb, Y—Rc and Z—Rd, the position of each other is not limited and may be randomly positioned. When the bond X—Rb's, Y—Rc's or Z—Rd's are repeated, the X—Rb's, Y—Rc's or Z—Rd's may be composed of two or more kinds of bonds;

Re and Rf may be the same or different and each represents hydrogen, carboxyl, hydroxyl, alkyl, alkenyl, alkynyl, aralkyl, cycloalkyl, allyl, polycyclic cycloalkyl, aryl, polycyclic aryl, —O-alkyl, —S-alkyl, —O-alkenyl, —O-alkynyl, —O-aralkyl, —O-allyl, —O-polycyclic cycloalkyl, —O-acetyl, —O-aryl or —O-polycyclic aryl;

among Re and Rf, the groups other than hydrogen, carboxyl and hydroxyl may be substituted by at least one group selected from the group consisting of halogen, cyano, formyl, alkoxy, carboxyl, acyl, nitro and hydroxyl.), (vi) a sulfide compound (excluding dithiodianiline) having a basic nitrogen atom represented by the following formula (2):

$$Rg—[(S)_x—Rh]p-[(S)_Y—Ri)]q \quad (2)$$

(wherein the symbols represent the following:

X and Y are each an integer of 1–4, p is 0 or an integer of 1–100, q is an integer of 1–100; in which (a) when p=0, Rg and Ri means (1) or (2) below:

(1) Rg and Ri are the same or different and each represents alkyl, alkenyl, alkynyl, aralkyl, cycloalkyl, polycyclic cycloalkyl, aryl, polycyclic aryl, heterocyclic group or polycyclic heterocyclic group, at least one of Rg and Ri having one or more basic nitrogen atom, or (2) Rg and Ri are bonded to each other and form a monocyclic or polycyclic ring having one or more basic nitrogen atom;

in the above (1) and (2), Rg and Ri may be the same or different;

(b) when p is an integer of 1–100, Rg, Rh and Ri mean (1) or (2) below:

(1) Rg and Ri represents alkyl, alkenyl, alkynyl, aralkyl, cycloalkyl, polycyclic cycloalkyl, aryl, polycyclic aryl, heterocyclic group or polycyclic heterocyclic group, Rh represents alkylene, alkenylene, alkynylene, aralkylene, cycloalkylene, polycyclic cycloalkylene, arylene, polycyclic arylene, heterocyclic group or polycyclic heterocyclic group, at least one of Rg, Rh and Ri having one or more basic nitrogen atom, or (2) Rg and Rh, Rg and Ri, or Rh and Ri are bonded, or Rg and Rh, and Rh and Ri are simultaneously bonded, forming a monocyclic or polycyclic ring having one or more basic nitrogen atom;

in the above (1) and (2), Rg, Rh and Ri may be the same or different;

in the above (a) and (b), Rg, Rh and Ri may be substituted by at least one group selected from the group consisting of halogen, amino, cyano, formyl, alkoxy, carboxyl, acyl, nitro and hydroxy.), and (v) a thiocrown ether compound.

2. The plating bath according to item 1, wherein the mercaptan compound comprises at least one basic nitrogen atom.

3. The plating bath according to item 1, wherein the thiocrown ether compound is at least one compound selected from the group consisting of the following (a)–(c):

(a) a thiocrown ether compound having at least one basic nitrogen atom, (b) a thiocrown ether compound having at least one basic nitrogen atom and at least one oxygen atom, (c) a compound in which at least two compounds selected from the group consisting of said thiocrown ether compounds (a) and said thiocrown ether compounds (b) are linked by a $C_1$–$C_5$ alkylene chain.

4. The plating bath according to item 1 which further comprising at least one compound selected from the group consisting of a compound having two or more nitrogen-containing aromatic rings in a molecule, unsaturated aliphatic carboxylic compound and a surfactant.

5. The plating bath according to item 4, wherein the surfactant is an alkylene oxide adduct of $C_8$–$C_{30}$ aliphatic amine.

6. A tin-copper-bismuth alloy plating bath comprising:

(A) a soluble tin(II) compound, (B) a soluble copper compound, (C) a soluble bismuth compound, and (D) at least one sulfur-containing compound selected from the group consisting of the following compounds (i)–(v):

(i) a thiourea compound, (ii) a mercaptan compound, (iii) an aliphatic sulfide compound represented the following formula (1):

$$Re—Ra—[(X—Rb)_L—(Y—Rc)_M—(Z—Rd)_N]—Rf \quad (1)$$

(wherein the symbols represent the following:

M is an integer of 1–100, L and N are each 0 or an integer of 1–100;

Y represents S or S—S, X and Z are the same or different and each represents O, S or S—S;

Ra represents a $C_1$–$C_{12}$ straight-chain or branched-chain alkylene, or 2-hydroxypropylene;

Rb, Rc and Rd are the same or different and each represents methylene, ethylene, propylene, 2-hydroxypropylene, butylene, pentylene or hexylene;

the positions of X—Rb, Y—Rc and Z—Rd are not limited and may be randomly positioned. When the bond X—Rb's, Y—Rc's or Z—Rd's are repeated, the X—Rb's, Y—Rc's or Z—Rd's may be composed of two or more kinds of bonds;

Re and Rf are the same or different and each represents hydrogen, carboxyl, hydroxy, alkyl, alkenyl alkynyl, aralkyl, cycloalkyl, allyl, polycyclic cycloalkyl, aryl, polycyclic aryl, —O-alkyl, —S-alkyl, —O-alkenyl, —O-alkynyl, —O-aralkyl, —O-allyl, —O-polycyclic cycloalkyl, —O-acetyl, —O-aryl or —O-polycyclic aryl;

among Re and Rf, the groups other than hydrogen, carboxyl and hydroxy may be substituted by at least one group selected from the group consisting of halogen, cyano, formyl, alkoxy, carboxyl, acyl, nitro and hydroxy.), (vi) a sulfide compound containing a basic nitrogen atom represented by the following formula (2):

$$Rg—[(S)_X—Rh]_p-[(S)_Y—Ri)]_q \quad (2)$$

(wherein the symbols represent the following:

X and Y are each an integer of 1–4, p is 0 or an integer of 1–100, q is an integer of 1–100; in which (a) when p=0, Rg and Ri means (1) or (2) below:

(1) Rg and Ri are the same or different and each represents alkyl, alkenyl, alkynyl, aralkyl, cycloalkyl, polycyclic cycloalkyl, aryl, polycyclic aryl, heterocyclic group or polycyclic heterocyclic group, at least one of Rg and Ri having one or more basic nitrogen atom, or (2) Rg and Ri are bonded to each other and form a monocyclic or polycyclic ring having one or more basic nitrogen atom;

in the above (1) and (2), Rg and Ri may be the same or different;

(b) when p is an integer of 1–100, Rg, Rh and Ri mean (1) or (2) below:

(1) Rg and Ri represents alkyl, alkenyl, alkynyl, aralkyl, cycloalkyl, polycyclic cycloalkyl, aryl, polycyclic aryl, heterocyclic group or polycyclic heterocyclic group, Rh represents alkylene, alkenylene, alkynylene, aralkylene, cycloalkylene, polycyclic cycloalkylene, arylene, polycyclic arylene, heterocyclic group or polycyclic heterocyclic group, at least one of Rg, Rh and Ri having one or more basic nitrogen atom, or, (2) Rg and Rh, Rg and Ri, or Rh and Ri are bonded, or Rg and Rh, and Rh and Ri are simultaneously bonded, forming a monocyclic or polycyclic ring having one or more basic nitrogen atom;

in the above (1) and (2), Rg, Rh and Ri may be the same or different;

in the above (a) and (b), Rg, Rh and Ri may be substituted by at least one group selected from the group consisting of halogen, amino, cyano, formyl, alkoxy, carboxyl, acyl, nitro and hydroxy.) and (v) a thiocrown ether compound.

7. The plating bath according to item 6 wherein the mercaptan compound contains at least one basic nitrogen atom.

8. The plating bath according to item 6, wherein the thiocrown ether compound is at least one compound selected from the group consisting of the following compounds (a)–(c):

(a) a thiocrown ether compound having at least one basic nitrogen atom, (b) a thiocrown ether compound having at least one basic nitrogen atom and at least one oxygen atom, (c) a compound in which at least two compounds selected from the group consisting of said thiocrown ether compounds (a) and said thiocrown ether compounds (b) are linked by a $C_1$–$C_5$ alkylene chain.

9. The plating bath according to item 6 which further comprises at least one compound selected from the group consisting of a compound having two or more nitrogen-containing aromatic rings in a molecule, an unsaturated aliphatic carboxylic compound and a surfactant.

10. The plating bath according to item 9, wherein the surfactant is an alkylene oxide adduct of $C_8$–$C_{30}$ aliphatic amine.

11. A tin-copper-silver alloy plating bath compressing:

(A) a soluble tin(II) compound, (B) a soluble copper compound, (C) a soluble silver compound, and (D) at least one sulfur-containing compound selected from the group consisting of the following compounds (i)–(iv):

(i) an aliphatic sulfide compound (excluding thiodiglycolic acid and thiodiglycol) represented by the following formula (1):

$$Re—Ra—[(X—Rb)_L—(Y—Rc)_M—(Z—Rd)_N]—Rf \quad (1)$$

(wherein the symbols represent the following:

M is an integer of 1–100, L and N are each 0 or an integer of 1–100;

Y represents S or S—S, X and Z are the same or different and each represents O, S or S—S;

Ra represents a $C_1$–$C_{12}$ straight-chain or branched-chain alkylene, or 2-hydroxypropylene;

Rb, Rc and Rd are the same or different and each represents methylene, ethylene, propylene, 2-hydroxypropylene, butylene, pentylene or hexylene;

the positions of X—Rb, Y—Rc and Z—Rd are not limited and may be randomly positioned. When the bond X—Rb's, Y—Rc's or Z—Rd's are repeated, the X—Rb's, Y—Rc's or Z—Rd's may be composed of two or more kinds of bonds;

Re and Rf are the same or different and each represents hydrogen, carboxyl, hydroxy, alkyl, alkenyl alkynyl, aralkyl, cycloalkyl, allyl, polycyclic cycloalkyl, aryl, polycyclic aryl, —O-alkyl, —S-alkyl, —O-alkenyl, —O-alkynyl, —O-aralkyl, —O-allyl, —O-polycyclic cycloalkyl, —O-acetyl, —O-aryl or —O-polycyclic aryl;

among Re and Rf, the groups other than hydrogen, carboxyl and hydroxy may be substituted by at least one group selected from the group consisting of halogen, cyano, formyl, alkoxy, carboxyl, acyl, nitro and hydroxy.), (ii) a sulfide compound containing a basic nitrogen atom represented by the following formula (2):

$$Rg—[(S)_X—Rh]_p-[(S)_Y—Ri)]_q \quad (2)$$

(wherein the symbols represent the following:

X and Y are each an integer of 1–4, p is 0 or an integer of 1–100, q is an integer of 1–100; in which (a) when p=0, Rg and Ri means (1) or (2) below:

(1) Rg and Ri are the same or different and each represents alkyl, alkenyl, alkynyl, aralkyl, cycloalkyl, polycyclic cycloalkyl, aryl, polycyclic aryl, heterocyclic group or polycyclic heterocyclic group, at least one of Rg and Ri having one or more basic nitrogen atom, or (2) Rg and Ri are bonded to each other and form a monocyclic or polycyclic ring having one or more basic nitrogen atom;

in the above (1) and (2), Rg and Ri may be the same or different;

(b) when p is an integer of 1–100, Rg, Rh and Ri mean (1) or (2) below:

(1) Rg and Ri represents alkyl, alkenyl, alkynyl, aralkyl, cycloalkyl, polycyclic cycloalkyl, aryl, polycyclic aryl, heterocyclic group or polycyclic heterocyclic group, Rh represents alkylene, alkenylene, alkynylene, aralkylene, cycloalkylene, polycyclic cycloalkylene, arylene, polycyclic arylene, heterocyclic group or polycyclic heterocyclic group, at least one of Rg, Rh and Ri having one or more basic nitrogen atom, or, (2) Rg and Rh, Rg and Ri, or Rh and Ri are bonded, or Rg and Rh, and Rh and Ri are simultaneously bonded, forming a monocyclic or polycyclic ring having one or more basic nitrogen atom;

in the above (1) and (2), Rg, Rh and Ri may be the same or different;

in the above (a) and (b), Rg, Rh and Ri may be substituted by at least one group selected from the group consisting of halogen, amino, cyano, formyl, alkoxy, carboxyl, acyl, nitro and hydroxy.), (iii) a mercaptan compound having at least one basic nitrogen atom, and (iv) a thiocrown ether compound.

12. The plating bath according to item 11, wherein the thiocrown ether compound is at least one compound selected from the group consisting of the following (a)–(c):

(a) a thiocrown ether compound having at least one basic nitrogen atom, (b) a thiocrown ether compound having at least one basic nitrogen atom and at least one oxygen atom, (c) a compound in which at least two compounds selected from the group consisting of said thiocrown ether compounds (a) and said thiocrown ether compounds (b) are linked by a $C_1$–$C_5$ alkylene chain.

13. The plating bath according to item 11 which further comprises at least one compound selected from the group consisting of a compound having two or more nitrogen-containing aromatic rings in a molecule, an unsaturated aliphatic carboxylic compound and a surfactant.

14. The plating bath according to item 13, wherein the surfactant is an alkylene oxide adduct of $C_8$–$C_{30}$ aliphatic amine.

15. A plating method for depositing a tin-copper alloy, the method comprising immersing an article to be plated in the plating bath of item 1 and forming a tin-copper alloy plated coating by electroplating.

16. A plating method for depositing a tin-copper-bismuth alloy, the method comprising immersing an article to be plated in the plating bath of item 6 and forming a tin-copper-bismuth alloy plated coating by electroplating.

17. A plating method for depositing a tin-copper-silver alloy, the method comprising immersing an article to be plated in the plating bath of item 11 and forming a tin-copper-silver alloy plated coating by electroplating.

18. An article which is provided with a tin-copper alloy plated coating by the plating method of item 15.

19. An article which is provided with a tin-copper-bismuth alloy plated coating by the plating method of item 16.

20. An article which is provided with a tin-copper-silver alloy plated coating by the plating method of item 17.

The present invention relates to an alloy plating bath containing tin and copper, more specifically to a tin-copper alloy plating bath, a tin-copper-silver alloy plating bath and a tin-copper-bismuth alloy plating bath.

Soluble Metal Compound

In these plating baths, any organic or inorganic soluble metal compound which can produce corresponding metal ions in water can be used as a metal compound.

Examples of the soluble tin(II) compound include tin(II) salts of organic sulfonic acid such as methanesulfonic acid, ethanesulfonic acid, 2-propanolsulfonic acid, p-phenolsulfonic acid and like, tin(II) borofluoride, tin(II) sulfosuccinate, tin(II) sulfate, tin(II) oxide, tin(II) chloride and the like. These soluble tin(II) compounds may be used singly or in combination of two or more kinds.

Examples of the soluble copper compound include copper salts of the aforementioned organic sulfonic acids, copper sulfate, copper chloride, copper oxide, copper carbonate, copper acetate, copper pyrophosphate, copper oxalate and the like. These soluble copper compounds may be used singly or in combination of two or more kinds.

Examples of the soluble silver compound include silver sulfate, silver sulfite, silver carbonate, silver nitrate, silver oxide, silver sulfosuccinate, silver salts of the above-mentioned organic sulfonic acids, silver citrate, silver tartrate, silver gluconate, silver oxalate and the like. These soluble silver compounds may be used singly or in combination of two or more kinds.

Example of the soluble bismuth compound include bismuth oxide, bismuth chloride, bismuth bromide, bismuth nitrate, bismuth sulfate, bismuth salts of the above organic sulfonic acids, bismuth sulfosuccinate and the like. These soluble bismuth compounds may be used singly or in combination of two or more kinds.

Among the above-mentioned soluble metal compounds, the amount of the soluble tin(II) compound is preferably about 0.01–2 mole/l, more preferably about 0.05–1 mole/l.

The amount of the soluble copper compound is preferably about 0.0001–0.5 mole/l, more preferably about 0.0005–0.05 mole/l.

The amount of the soluble bismuth compound is preferably about 0.00003–0.05 mole/l, more preferably about 0.0002–0.02 mole/l.

The amount of the soluble silver compound is preferably about 0.00008–0.1 mole/l, more preferably about 0.0004–0.03 mole/l.

The ratio of the metal compounds in the tin-copper alloy plating bath, tin-copper-silver alloy plating bath and tin-copper-bismuth alloy plating bath can be suitably selected depending on the desired composition of the plated alloy coating. For example, in order to obtain a deposit of a tin-rich plated alloy coating containing tin and copper, which can be a substitute for a solder coating in which the weight ratio of tin to lead is 9:1, the molar ratio of the tin compound and other metal compounds in the plating bath may be about 99:1 to about 85:15.

In the tin-copper alloy plating bath, tin-copper-silver alloy plating bath and tin-copper-bismuth alloy plating bath, the total amount of the soluble metal compounds is preferably about 0.0101–2.65 mole/l, more preferably about 0.0505–1.1 mole/l.

Acids and Salts Thereof

The plating bath containing tin and copper of the present invention comprises, as a basic component, at least one component selected from the group consisting of acids and their salts. Useful acids include organic sulfonic acid, aliphatic carboxylic acid and like organic acids; sulfuric acid, hydrochloric acid, fluoroboric acid, fluorosilicic acid, sulfamic acid and like inorganic acids. In the present invention, particularly among the above acid and their salts, the organic sulfonic acids, their salts and the like are preferable in terms of the metal salts dissolvability, wastewater disposability, etc.

Useful organic sulfonic acids include alkanesulfonic acid, alkanolsulfonic acid, aromatic sulfonic acid and the like.

Among the above acids, as the alkanesulfonic acids may be used a compound represented by the chemical formula $C_nH_{2n+1}SO_3H$ (for example, n=1 to 11). Examples of the alkanesulfonic acid include methanesulfonic acid, ethanesulfonic acid, 1-propanesulfonic acid, 2-propanesulfonic acid, 1-buthanesulfonic acid, 2-buthanesulfonic acid, pentanesulfonic acid, hexanesulfonic acid, decanesulfonic acid, dodecanesulfonic acid and the like.

As the alkanolsulfonic acid may be used a compound represented by the chemical formula:

$$C_mH_{2m+1}—CH(OH)—C_pH_{2p}—SO_3H$$

(for example, m=0 to 6, p=1 to 5). Examples of the alkanolsulfonic acid include 2-hydroxyethane-1-sulfonic acid, 2-hydroxypropane-1-sulfonic acid (2-propanolsulfonic acid), 2-hydroxybutane-1-sulfonic acid, 2-hydroxypentane-1-sulfonic acid, 1-hydroxypropane-2-sulfonic acid, 3-hydroxypropane-1-sulfonic acid, 4-hydroxybutane-1-sulfonic acid, 2-hydroxyhexane-1-sulfonic acid, 2-hydroxydecane-1-sulfonic acid, 2-hydroxydodecane-1-sulfonic acid and the like.

Examples of the aromatic sulfonic acid include benzenesulfonic acid, alkylbenzenesulfonic acid, phenolsulfonic acid, naphthalenesulfonic acid, alkylnaphthalenesulfonic acid, naphtholsulfonic acid and the like. More specifically, useful are 1-naphthalenesulfonic acid, 2-naphthalenesulfonic acid, toluenesulfonic acid, xylenesulfonic acid, p-phenolsulfonic acid, cresolsulfonic acid, sulfosalicylic acid, nitrobenzenesulfonic acid, sulfobenzoic acid, diphenylamine-4-sulfonic acid and the like.

The salts of the above acids may be any soluble salts of these acids, for example, Na salts, K salts and like alkali metal salts, Ca salts and like alkali earth metal salts, diethylamine salts and like alkyl amine salts, ammonium salts and the like.

Among the above organic sulfonic acids and their salts, preferable are methanesulfonic acid, ethanesulfonic acid, 2-propanolsulfonic acid, phenolsulfonic acid, the salts of these acids and the like.

In the alloy plating bath containing tin and copper of the present invention, the above acids and their salts may be used singly or in combination of two or more kinds. The amount of the acids and their salts is preferably about 0.01–50 mole/l, more preferably about 0.1–10 mole/l.

Sulfur-containing Compound

The alloy plating bath containing tin and copper of the present invention essentially contains a specific sulfur-containing compound as an additive.

The sulfur-containing compound used as an additive varies depending on the kind of the alloy plating bath. In the following, the sulfur-containing compounds are described by the types of the alloy plating baths for which the sulfur-containing compound is useful.

Sulfur-containing Compound in Tin-copper Alloy Plating Bath

In the tin-copper alloy plating bath, as the sulfur-containing compound is used at least one compound selected from the group consisting of (i)–(v) listed below. It should be noted that the sulfide compound containing a basic nitrogen atom represented by the formula (2) does not include dithiodianiline.

(i) a thiourea compound, (ii) a mercaptan compound, (iii) an aliphatic sulfide compound represented by the following formula (1):

$$Re—Ra—[(X—Rb)_L—(Y—Rc)_M—(Z—Rd)_N]—Rf \quad (1)$$

(wherein the symbols represent the following:

M is an integer of 1–100, L and N are each 0 or an integer of 1–100;

Y represents S or S—S, X and Z are the same or different and each represents O, S or S—S;

Ra represents a $C_1$–$C_{12}$ straight-chain or branched-chain alkylene, or 2-hydroxypropylene;

Rb, Rc and Rd are the same or different and each represents methylene, ethylene, propylene, 2-hydroxypropylene, butylene, pentylene or hexylene;

the positions of X—Rb, Y—Rc and Z—Rd are not restricted and may be random. When the bond X—Rb's, Y—Rc's or Z—Rd's are repeated, the X—Rb's, Y—Rc's or Z—Rd's may be composed of two or more kinds of bonds;

Re and Rf are the same or different and each represents hydrogen, carboxyl, hydroxy, alkyl, alkenyl alkynyl, aralkyl, cycloalkyl, allyl, polycyclic cycloalkyl, aryl, polycyclic aryl, —O-alkyl, —S-alkyl, —O-alkenyl, —O-alkynyl, —O-aralkyl, —O-allyl, —O-polycyclic cycloalkyl, —O-acetyl, —O-aryl or —O-polycyclic aryl;

among Re and Rf, the groups other than hydrogen, carboxyl and hydroxy may be substituted by at least one group selected from the group consisting of halogen, cyano, formyl, alkoxy, carboxyl, acyl, nitro and hydroxy.), (vi) a sulfide compound (excluding dithiodianiline) containing a basic nitrogen atom represented by the following formula (2):

$$Rg—[(S)_x—Rh]p-[(S)_y—Ri)]q \quad (2)$$

(wherein the symbols represent the following:

X and Y are each an integer of 1–4, p is 0 or an integer of 1–100, q is an integer of 1–100; in which (a) when p=0, Rg and Ri means (1) or (2) below:

(1) Rg and Ri are the same or different and each represents alkyl, alkenyl, alkynyl, aralkyl, cycloalkyl, polycyclic cycloalkyl, aryl, polycyclic aryl, heterocyclic group or polycyclic heterocyclic group, at least one of Rg and Ri having one or more basic nitrogen atom, or (2) Rg and Ri are bonded to each other and form a monocyclic or polycyclic ring having one or more basic nitrogen atom;

In the above (1) and (2), Rg and Ri may be the same or different;

(b) when p is an integer of 1–100, Rg, Rh and Ri mean (1) or (2) below:

(1) Rg and Ri represents alkyl, alkenyl, alkynyl, aralkyl, cycloalkyl, polycyclic cycloalkyl, aryl, polycyclic aryl, heterocyclic group or polycyclic heterocyclic group, Rh represents alkylene, alkenylene, alkynylene, aralkylene, cycloalkylene, polycyclic cycloalkylene, arylene, polycyclic arylene, heterocyclic group or polycyclic heterocyclic group, at least one of Rg, Rh and Ri having one or more basic nitrogen atom, or, (2) Rg and Rh, Rg and Ri, or Rh and Ri are bonded, or Rg and Rh, and Rh and Ri are simultaneously bonded, forming a monocyclic or polycyclic ring having one or more basic nitrogen atom;

in the above (1) and (2), Rg, Rh and Ri may be the same or different;

in the above (a) and (b), Rg, Rh and Ri may be substituted by at least one group selected from the group consisting of halogen, amino, cyano, formyl, alkoxy, carboxyl, acyl, nitro and hydroxy.), and (v) a thiocrown ether compound.

The tin-copper alloy plating bath comprising the aforementioned specific sulfur-containing compound is effective in preventing the deposition of copper on the tin anode by substitution in electroplating. In addition, the tin-copper alloy plating bath can form a plated coating having low dependency of composition on the current density. The tin-copper alloy plating bath has high bath stability and prevents turbidness.

Among the sulfur-containing compounds useful for the tin-copper plating bath, as the thiourea compound may be used at least one compound selected from the group consisting of thiourea and its derivatives. Examples of the thiourea derivatives include 1,3-dimethylthiourea, trimethylthiourea, diethylthiourea, N,N'-diisopropylthiourea, allylthiourea, acetylthiourea, ethylenethiourea, 1,3-diphenylthiourea, thiourea dioxide and the like.

As the mercaptan compound may be used any compound having a mercapto group in its molecule. Examples of such compound include thioglycol, thioglycolic acid, mercaptosuccinic acid, mercaptolactic acid, acetylcysteine, penicillamine and like aliphatic mercaptan compounds; 5-mercapto-1,3,4-triazole, 3-mercapto-4-methyl-4H-1,2,4-triazole and like aromatic or heterocyclic mercaptan compounds and the like.

Among these mercaptan compounds, preferable are penicillamine, 5-mercapto-1,3,4-triazole, 3-mercapto-4-methyl-4H-1,2,4-triazole and like mercaptan compounds having at least one basic nitrogen atom.

In the formula (1) and formula (2) which represent the sulfide compounds useful for the tin-copper plating bath of the invention, a preferable alkyl group is $C_1$–$C_6$ straight-chain or branched-chain alkyl; a preferable alkenyl is $C_2$–$C_6$ straight-chain or branched chain alkenyl; a preferable alkynyl is $C_2$–$C_6$ straight-chain or branched-chain alkynyl; preferable aralkyl include benzyl, phenethyl, styryl and the like; preferable cycloalkyl include cyclopentyl, cyclohexyl and the like; preferable polycyclic cycloalkyl include adamantyl and the like; preferable aryl include phenyl, cumenyl and the like; preferable polycyclic aryl include naphthyl, phenanthryl and the like; preferable heterocyclic groups and polycyclic heterocyclic groups include groups derived from pyridine ring, pyrrole ring, pyrazine ring, pyridazine ring, thiazole ring, thiadiazole ring, imidazoline ring, imidazole ring, thiazoline ring, triazole ring, tetrazole ring, picoline ring, furazan ring, piperidine ring, piperazine ring, triazine ring, morpholine ring, benzothiazole ring, benzimidazole ring, quinoline ring, quinoxaline ring, pteridine ring, phenanthroline ring, phenazine ring, indoline ring, perhydroindoline ring and the like.

Preferable examples of the alkylene, alkenylene, alkynylene, aralkylene, cycloalkylene, polycyclic cycloalkylene, polycyclic arylene, heterocyclic group and polycyclic heterocyclic group represented by Rh in the formula (2) are the divalent groups derived from the groups mentioned as the examples of alkyl, alkenyl, alkynyl, aralkyl, cycloalkyl, polycyclic cycloalkyl, aryl, polycyclic aryl, heterocyclic group or polycyclic heterocyclic group.

Among Re and Rf in the above formula (1), the groups other than hydrogen, carboxyl and hydroxy may have at least one substituent selected from the group consisting of halogen (chlorine, fluorine, bromine, etc.), cyano, formyl, alkoxy (preferably $C_1$–$C_6$ alkoxy), carboxyl, acyl (preferably $C_1$–$C_6$ acyl), nitro and hydroxy. Rg, Rh and Ri in the formula (2) may be substituted by at least one group selected from the group consisting of the above-mentioned substituents and amino group.

The aliphatic sulfide compound represented by the formula (1) has a sulfide bond or disulfide bond in its molecule and it does not contain a basic nitrogen atom. Examples of such aliphatic sulfide compound are as follows. In the structural formulas, Ph represents a phenyl group.

(1) Thiobis(diethyleneglycol) represented by $H—(OCH_2CH_2)_2—S—(CH_2CH_2O)_2—H$ (2) Thiobis(hexaethylene glycol)

(3) Thiobis(pentadecaglycelol) represented by $H—(OCH_2CH(OH)CH_2)_{15}—S—(CH_2CH(OH)CH_2O)_{15}—H$ (4) Thiobis(icosaethyleneglycol) represented by $H—(OCH_2CH_2)_{20}—S—(CH_2CH_2O)_{20}—H$ (5) Thiobis(pentacontaethyleneglycol)

(6) 4,10-dioxa-7-thiatridecane-2,12-diol represented by $HO—CH(CH_3)CH_2—OCH_2CH_2—SCH_2CH_2—OCH_2CH(CH_3)—OH$ (7) Thiodiglycerin represented by $HOCH_2CH(OH)CH_2—S—CH_2CH(OH)CH_2OH$ (8) Thiobis(triglycerin) represented by $H—(OCH_2CH(OH)CH_2)_3—S—(CH_2CH(OH)CH_2O)_3—H$ (9) 2,2'-thiodibutanolbis(octaethyleneglycolpentaglycerol) ether represented by $H—(OCH_2CH(OH)CH_2)_5—(OCH_2CH_2)_8—OC_4H_8—SC_4H_8—O—(CH_2CH_2O)_8—(CH_2CH(OH)CH_2O)_5—H$

(10) Thiobis(octaethyleneglycol)bis(2-chloroethyl)ether represented by $Cl—CH_2CH_2CH_2—(OCH_2CH_2)_8—S—(CH_2CH_2O)_8—CH_2CH_2CH_2—Cl$

(11) Thiobis(decaethyleneglycol)bis(carboxymethyl)ether

(12) Thiobis(dodecaethyleneglycol)bis(2-nitroethyl)ether

(13) Thiodiglycolbis(carboxymethyl)ether represented by $HOOCCH_2OCH_2CH_2—S—CH_2CH_2OCH_2COOH$

(14) Dithiodiglycolbis(carboxymethyl)ether represented by $HOOCCH_2OCH_2CH_2—S—S—CH_2CH_2OCH_2COOH$

(15) Thiobis(dodecaethyleneglycol) represented by $H—(OCH_2CH_2)_{12}—S—(CH_2CH_2O)_{12}—H$

(16) Dithiobis(hentetracontaethyleneglycol) represented by $H—(OCH_2CH_2)_{41}—S—S—(CH_2CH_2O)_{41}—H$

(17) Dithiobis(icosaethyleneglycolpentapropyleneglycol) represented by $H—(OC_3H_6)_5—(OC_2H_4)_{20}—S—S—(OC_2H_4)_{20}—(OC_3H_6)_5—H$

(18) Dithiobis(triglycerol) represented by $H—(OCH_2CH(OH)CH_2)_3—S—S—(CH_2CH(OH)CH_2O)_3—H$

(19) Dithiobis(decaglycelol)

(20) 3,6-Dithiaoctane-1,8-diol represented by $HOCH_2CH_2S—CH_2CH_2—SCH_2CH_2OH$

(21) 1,3-Propanedithiolbis(decaethyleneglycol)thioether represented by $H—(OC_2H_4)_{10}—S—C_3H_6—S—(OC_2H_4)_{10}—H$

(22) 1,4-Buthanedithiolbis(pentadecaglycerol)thioether represented by $H—(OCH_2CH(OH)CH_2)_{15}—S—C_4H_8—S—(CH_2CH(OH)CH_2O)_{15}—H$

(23) 1,3-Dithioglycerolbis(pentaethyleneglycol)thioether represented by $H—(OCH_2CH_2)_5—SCH_2CH(OH)CH_2S—(CH_2CH_2O)_5—H$

(24) 1,2-Ethanedithiolbis(penta(1-ethyl)ethyleneglycol) thioether represented by $H—(OCH(C_2H_5)CH_2)_5—SC_2H_4S—(CH_2CH(C_2H_5)O)_5—H$

(25) 1,3-Dithioglycerolbis(di(1-ethyl)ethyleneglycol) thioether represented by $H—(OCH(CH_3)CH_2)_2—SCH_2CH(OH)CH_2S—(CH_2CH(CH_3)O)_2—H$

(26) 2-Mercaptoethylsulfide bis(hexatriacontaethyleneglycol) represented by $H-(OC_2H_4)_{18}—SC_2H_4—SC_2H_4—S—(C_2H_4O)_{18}—H$

(27) 2-Mercaptoethylsulfidebis(icosaethyleneglycol)dimethylether represented by $CH_3—(OC_2H_4)_{10}—SC_2H_4—SC_2H_4—S—(C_2H_4O)_{10}–CH_3$

(28) 2-Mercaptoethyletherbis(diethyleneglycol) represented by $H—(OC_2H_4)_2—S—CH_2CH_2OCH_2CH_2—S—(C_2H_4O)_2—H$

(29) Thiodiglyceroltetra(decaethyleneglycol)ether represented by the above formula (6)

(30) Diethyleneglycolmonomethylthioether represented by $CH_3—S—(CH_2CH_2O)_2—H$

(31) Decaglycerolmono(6-methylthiohexyl)thioether represented by $CH_3—S—C_6H_{12}—S—(CH_2CH(OH)CH_2O)_{10}—H$

(32) 2-Mercaptoethylsulfide-ω-{(2-bromoethyl) icosaethyleneglycol}thioether-ω'-{(2-bromoethyl) hectaethyleneglycol}thioether represented by $BrCH_2CH_2—(OCH_2CH_2)_{20}—(S—CH_2CH_2)_3—(OCH_2CH_2)_{100}—OCH_2CH_2Br$

(33) 1,4-Butanediol-ω-{(2-benzyloxy-1-methyl) ethyl}thioether-ω'-(decapropyleneglycoloctacontaethyleneglycol)thioether represented by $PhCH_2OCH_2CH(CH_3)—S—C_4H_8—S—(CH_2CH_2O)_{80}—(CH_2CH(CH_3)O)_{10}—H$

(34) Dithiobis(icosaethyleneglycol)bis(2-methyl-thioethyl) ether represented by $CH_3—S—CH_2CH_2—(OCH_2CH_2)_{20}—S—S—(CH_2CH_2O)_{20}—CH_2CH_2S—CH_3$

(35) 1,2-Ethanediol-ω-(4-methoxybenzyl)thioether-ω'-(pentacontaethyleneglycol)thioether represented by $CH_3O—Ph—CH_2S—CH_2CH_2—(CH_2CH_2O)_{50}—H$

(36) Triacontaethyleneglycolmono(4-cyanobenzyl)thioether represented by $NC—Ph—CH_2S—(CH_2CH_2O)_{30}—H$

(37) Thiobis(pentadecaethyleneglycol)bisallylether represented by $CH_2{=}CHCH_2—(OCH_2CH_2)_{15}—S—(CH_2CH_2O)_{15}—CH_2CH{=}CH_2$

(38) Tricosaethyleneglycolmono(4-formylphenetyl) thioether represented by $OHC—Ph—CH_2CH_2—S—(CH_2CH_2O)_{23}—H$

(39) Pentadecaethyleneglycolmono{(acetylmethyl) thioethyl}thioether represented by $CH_3COCH_2—S—CH_2CH_2—S—(CH_2CH_2O)_{15}—H$

(40) 1,2-Ethanediol-ω-(glycidyl)thioether-ω'-icosaethyleneglycolthioether represented by the following formula

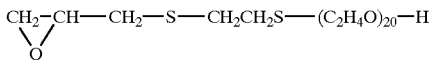

(41) Octadecaethyleneglycolbis(2-methylthioethyl)ether represented by $CH_3—S—CH_2CH_2CO—(CH_2CH_2O)_{18}—CH_2CH_2S—CH_3$

(42) Hexadecaethyleneglycolmono(2-methylthioethyl) thioether represented by $CH_3—S—CH_2CH_2—S—(CH_2CH_2O)_{16}—H$

(43) Icosaethyleneglycolmonomethylthioether represented by $CH_3—S—(CH_2CH_2O)_{20}—H$

(44) Undecaethyleneglycoldi(n-propyl)thioether represented by $C_3H_7—S—(CH_2CH_2O)_{10}—CH_2CH_2S—C_3H_7$

(45) Dodecaethyleneglycolbis(2-hydroxyethyl)thioether represented by $HOCH_2CH_2S—(CH_2CH_2O)_{11}—CH_2CH_2S—CH_2CH_2OH$

(46) Undecaethyleneglycoldimethylthioether

(47) Pentatriacontaethyleneglycolmono(2-n-butyldithioethyl)dithioether represented by $C_4H_9—S—S—CH_2CH_2—S—S—(CH_2CH_2O)_{35}—H$

(48) 4,8,12-trithiapentadecane-1,2,6,10,14,15-hexaol represented by $HOCH_2CH(OH)CH_2—S—CH_2CH(OH)CH_2—S—CH_2CH(OH)CH_2—S—CH_2CH(OH)CH_2OH$

(49) Icosaglycerolmono(2-ethylthioethyl)thioether represented by $C_2H_5—S—CH_2CH_2—S—(CH_2CH(OH)CH_2O)_{20}—H$

(50) Triacontaethyleneglycolmono(2-methylthioethyl) thioether represented by $CH_3—S—CH_2CH_2—S—(C_2H_4O)_{30}—H$

(51) Dithiobis(icosaethyleneglycol)dibenzylether represented by $Ph—CH_2—(OC_2H_4)_{20}—S—S—(C_2H_4O)_{20}—CH_2—Ph$

(52) Tridecaethyleneglycolmonomethylthioether represented by $CH_3—S—(CH_2CH_2O)_{10}—H$

(53) Hexadecaethyleneglycol dimethylthioether represented by $CH_3—S—(CH_2CH_2O)_{15}—CH_2CH_2S—CH_3$

(54) 1,2-Ethanedithiolbis(icosaethyleneglycol)thioether represented by $H—(OCH_2CH_2)_{20}—S—CH_2CH_2—S—(CH_2CH_2O)_{20}—H$

(55) Dithiobis(pentadecaethyleneglycol) represented by $H—(OCH_2CH_2)_{15}—S—S—(CH_2CH_2O)_{15}—H$

(56) 3,3'-thiodipropanol represented by $HO—CH_2CH_2CH_2—S—CH_2CH_2CH_2—OH$

The sulfide compound represented by the above formula (2) has one or more bonds in its molecule, the bond being at least one bond selected from the group consisting of sulfide, disulfide, trisulfide and tetrasulfide bonds. The sulfide compound also contains at least one basic nitrogen atom. Such sulfide compound include aliphatic sulfide compound, aromatic sulfide compound and like various sulfide compounds. However, the tin-copper alloy plating bath of the present invention does not include dithiodianiline.

Such sulfide compound containing a basic nitrogen atom represented by the formula (2) is described specifically. For example, in 2,2'-di(1-methylpyrrolyl)disulfide, both pyrrole rings at both ends of a disulfide bond have a basic nitrogen atom each, while in 2,2'-dithiodianiline, benzene rings at both ends of a disulfide bond each have a substituted amino group containing a basic nitrogen atom.

Examples of the sulfide compound having at least one basic nitrogen atom represented by the formula (2) include the followings.

(1) 2-Ethylthioaniline
(2) 2-(2-aminoethyldithio)pyridine
(3) 2,2'-dithiadiazolyldisulfide
(4) 5,5'-di(1,2,3-triazolyl)disulfide
(5) 2,2'-dipyradinyldisulfide
(6) 2,2'-dipyridyldisulfide
(7) 4,4'-dipyridyldisulfide
(8) 2,2'-diamino-4,4'-dimethyldiphenyldisulfide
(9) 2,2'-dipyridazinyldisulfide
(10) 5,5'-dilpyrimidinyldisulfide
(11) 2,2'-di(5-dimethylaminothiadiazolyl)disulfide

(12) 5,5'-di(1-methyltetrazolyl)disulfide
(13) 2,2'-di(1-methylpyrrolyl)disulfide
(14) 2-pyridyl-2-hydroxyphenyldisulfide
(15) 2,2'-dipiperidyldisulfide
(16) 2,2'-dipyridylsulfide
(17) 2,6-di(2-pyridyldithio)pyridine
(18) 2,2'-dipiperazinyldisulfide
(19) 2,2'-di(3,5-dihydroxypyrimidinyl)disulfide
(20) 2,2'-diquinolyldisulfide
(21) 2,2'-di{6-(2-pyridyl)}pyridyldisulfide
(22) 2,2'-α-picolyldisulfide
(23) 2,2'-di(8-hydroxyquinolyl)disulfide
(24) 5,5'-diimidazolyldisulfide
(25) 2,2'-dithiazolyldisulfide
(26) 2-pyridyl-2-aminophenyldisulfide
(27) 2-pyridyl-2-quinolyldisulfide
(28) 2,2'-dithiazolinyldisulfide
(29) 2,2'-di(4,5-diamino-6-hydroxypyrimidinyl)disulfide
(30) 2,2'-di(6-chloropyridyl)tetrasulfide
(31) 2,2'-dimororpholinodisulfide
(32) 2,2'-di(8-methoxyquinolyl)disulfide
(33) 4,4'-di(3-methoxycarbonylpyridyl))disusulfide
(34) 2-pyridyl-4-methylthiophenyldisulfide
(35) 2-piperazinyl-4-ethoxymethylphenyldisulfide
(36) 2,2'-di{6-(2-pyridyldithio)pyridyl}disulfide
(37) 2,2'-diquinoxalinyldisulfide
(38) 2,2'-dipteridinyldisulfide
(39) 3,3'-difurazanyldisulfide
(40) 3,3'-diphenanthrolinyldisulfide
(41) 8,8'-diquinolyldisulfide
(42) 1,1'-diphenadinyldisulfide
(43) 4,4'-di(3-carboxylpyridyl)trisulfide
(44) 2,2'-dithiazolinyldisulfide
(45) 2,2'-dipicolyldisulfide
(46) dimethylaminodiethyldisulfide
(47) 2,2'-diperhydroindolyldisulfide
(48) 6,6'-diimidazo[2,1-b]thiazolyldisulfide
(49) 2,2'-di(5-nitrobenzimidazolyl)disulfide
(50) 2,4,6-tris(2-pyridyldithio)-1,3,5-triazine
(51) 2-aminoethyl-2'-hydroxyethyldisulfide
(52) di(2-pyridylthio)methane
(53) 2,4,6-tris(2-pyridyl)-1,3,5-trithiane
(54) 5,5'-diamino-2,11-dithio[3,3]paracyclophane
(55) 2,3-dithia-1,5-diazaindane
(56) 2,4,6-trithia-3a,7a-diazaindene
(57) 1,8-diamino-3,6-dithiaoctane represented by the following formula:

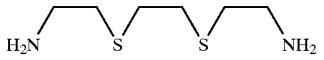

(58) 1,11-bis(methylamino)-3,6,9-trithiaundecane represented by the following formula:

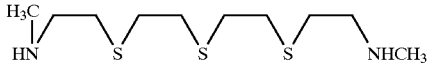

(59) 1,14-bis(methylamino)-3,6,9,12-tetrathiatetradecane represented by the following formula:

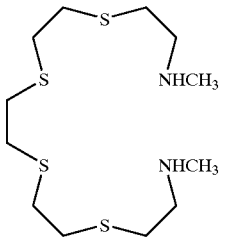

(60) 1,10-di(2-pyridyl)-1,4,7,10-tetrathiadecane represented by the following formula:

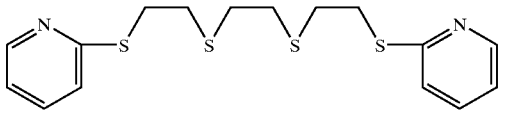

The thiocrown ether compound which is useful for the present invention is a cyclic thioether compound. Examples of the cyclic thioether compound include the following compounds (a)–(c).

(a) a thiocrown ether compound having at least one basic nitrogen atom
(b) a thiocrown ether compound having at least one basic nitrogen atom and at least one oxygen atom
(c) a compound in which at least two compounds selected from the group consisting of the above thicrown ether compounds (a) and the thiocrown ether compounds (b) are linked by a $C_1$–$C_5$ alkylene chain.

The above thiocrown ether compound (a) (azathiacrown ether compound) is a compound which can be obtained by replacing an oxygen atom in crown ether with a sulfur atom and has at least one basic nitrogen atom in its molecule. Examples of the thiocrown ether compound include the following compounds.

(i) 1-Aza-4,7,11,14-tetrathiacyclohexadecane represented by the following formula

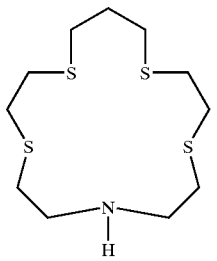

(ii) 1,10-Diaza-4,7,13,16-tetrathiacyclooctadecane represented by the following formula

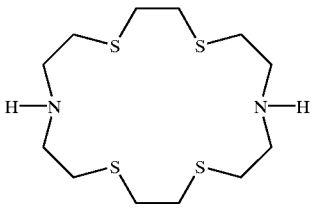

(iii) 1,10-Diaza-1,10-dimethyl-4,7,13,16-tetrathiacyclooctadecane represented by the following formula

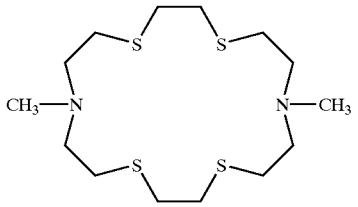

(iv) 1,16-Diaza-1,16-bis(2-hydroxybenzyl)-4,7,10,13,19,22,25,28-octathiacyclotriacontane represented by the following formula

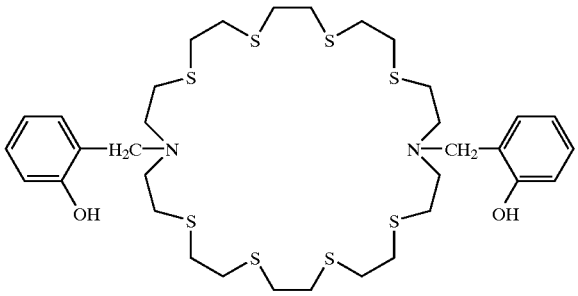

(v) 7,8,9,10,18,19,20,21-Octahydro-6H,17H-dibenzo[b,k][1,4,10,13,7,16]tetrathiadiazacyclooctadecane represented by the following formula

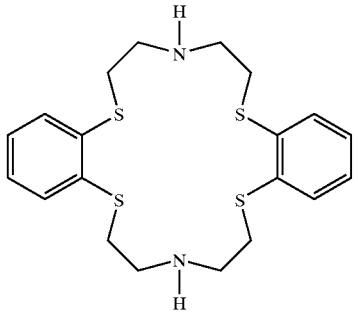

(vi) 3,6,14,17-Tetrathiatricyclo[17.3.1.18,12]tetracosa-1,8,10,12,19,21-hexaene-23,24-diamine represented by the following formula

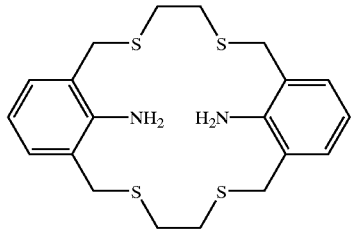

(vii) 3,7,15,19-Tetrathia-25,26-diazatricyclo[19.3.1.19,13]hexacosa-1,9,11,13,21,23-hexaene represented by the following formula

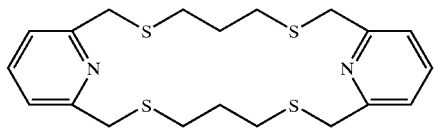

(viii) 6,13-Diamino-1,4,8,11-tetrathiacyclotetradecane represented by the following formula

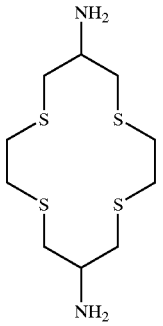

The above thiocrown ether compound (b) (azaoxathiacrown ether compound) is a compound which comprises at least one oxygen atom in the above thiocrown ether compound (a). Examples of this compound include the following compounds.

(i) 1-Aza-7-oxa-4,10-dithiacyclododecane represented by the following formula

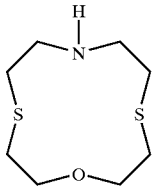

(ii) 2,23-Diaza-5,20-dioxa-8,11,14,17-tetrathiabicyclo[22.2.2]octacosa-1,24,27-triene represented by the following formula

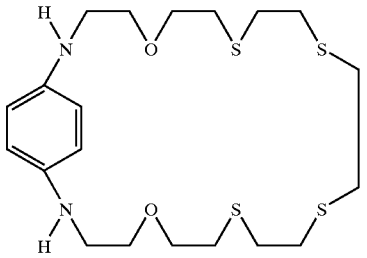

(iii) 1,10-Diaza-4,7-dioxa-13,16,21,24-tetrathiabicyclo[8.8.8]hexacosane represented by the following formula

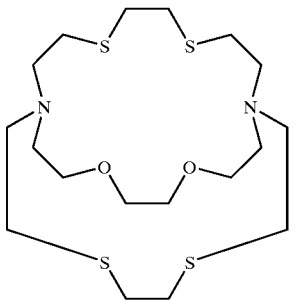

The above compound (c) is a compound prepared by linking, for example, two or more of the above azathiacrown ether compounds (a), two or more of the above azaoxathiacrown ether compounds (b), or the above azathiacrown ether compound (a) and the above azaoxathiacrown ether compound (b), through a $C_1$–$C_5$ alkylene chain. Two or more thiocrown ether rings may be linked through the alkylene chain(s). Examples of the above compound (c) include 1,1'-(1,2-ethanediyl)bis-1-aza-4,7,10-trithiacyclododecane represented by the following formula.

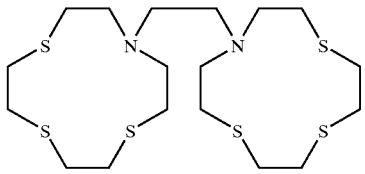

Sulfur-containing Compound in Tin-copper-bismuth Alloy Plating Bath

Unlike the tin-copper alloy plating bath, the tin-copper-bismuth alloy plating bath of the present invention may use 2,2'-dithiodianiline and like dithiodianiline as the sulfide compound containing the basic nitrogen represented by the formula (2). However, other conditions of the sulfur-containing compounds are the same as in the tin-copper alloy plating bath. Specifically, the tin-copper-bismuth alloy plating bath contains, as the sulfur-containing compound, at least one compound selected from the group consisting of the following compounds (i)–(v).

(i) a thiourea compound;

(ii) a mercaptan compound;

(iii) an aliphatic sulfide compound represented by the following formula (1):

$$Re—Ra—[(X—Rb)_L—(Y—Rc)_M—(Z—Rd)_N]—Rf \quad (1)$$

(wherein the symbols are as described in the above);

(iv) a sulfide compound containing a basic nitron atom represented by the following formula (2):

$$Rg—[(S)_X—Rh]p-[(S)_Y—Ri)]q \quad (2)$$

(wherein the symbols are as described in the above);

(v) a thiocrown ether compound.

Examples of these sulfur-containing compounds are the same as those of the tin-copper alloy plating bath.

Such tin-copper-bismuth alloy plating bath containing the above-specified sulfur-containing compound has resistance to deposition of copper on the anode by substitution, low dependency of the composition of the plated coating on current density, good bath stability and resistance to turbidness.

Sulfur-containing Compound in Tin-copper-silver Alloy Plating Bath

The sulfur-containing compound useful for the tin-copper-silver alloy plating bath of the present invention are more restricted than those for the tin-copper alloy plating bath and the tin-copper-bismuth alloy plating bath. Specifically, useful are at least one sulfur-containing compound selected from the group consisting of the below compounds (i)–(iv).

(i) an aliphatic sulfide compound (excluding thiodiglycolic acid and thiodiglycol) represented by the general formula (1):

$$Re—Ra—[(X—Rb)_L—(Y—Rc)_M—(Z—Rd)_N]—Rf \quad (1)$$

(wherein the symbols are as defined in the above);

(ii) a sulfide compound containing a basic nitrogen atom represented by the formula (2):

$$Rg—[(S)_X—Rh]p-[(S)_Y—Ri)]q \quad (2)$$

(wherein the symbol are as defined in the above);

(iii) a mercaptan compound having at least one basic nitrogen atom; and (iv) a thiocrown ether compound.

Such tin-copper-silver alloy plating bath which comprises the above-specified sulfur-containing compound has resistance to deposition of copper on the anode by substitution, low dependency of the composition of the plated coating on current density, good bath stability and resistance to turbidness.

Among the sulfur-containing compounds useful for the tin-copper-silver plating bath, as the aliphatic sulfide compounds represented by the formula (1) may be used the same compounds as the aliphatic sulfide compound of the formula (1) useful for the above-mentioned tin-copper alloy plating bath, except that thiodiglycolic acid and thiodiglycol can not be used.

As the sulfide compound containing a basic nitrogen atom of the formula (2) may be used the same compounds as the aliphatic sulfide compound of the formula (2) which is useful for the tin-copper alloy plating bath. Additionally, 2,2'-dithiodianiline and like dithiodianiline may be used.

As the mercaptan compound having at least one basic nitrogen atom may be used acetylcysteine and like aliphatic mercaptan compounds, 5-mercapto-1,3,4-triazole and like aromatic or heterocyclic mercaptan compounds and the like. Incidentally, acetylcysteine has a basic nitrogen atom in an amino group, while 5-mercapto-1,3,4-triazole has a basic nitrogen atom in a triazole ring.

Therefore, the mercaptan compound useful for the tin-copper-silver alloy plating bath of the present invention does not include thioglycol, thioglycolic acid, mercaptosuccinic acid and like mercaptan compounds which do not contain the basic nitrogen atom.

The thiocrown ether compound useful for the tin-copper-silver alloy plating bath of the present invention is the same as the compound which is useful for the above-mentioned tin-copper alloy plating bath.

As mentioned in the above, the sulfur-containing compound useful for the tin-copper-silver alloy plating bath of the present invention are more restricted than those useful for the tin-copper alloy plating bath and tin-copper-bismuth alloy plating bath. When using other compounds than the above-specified sulfur-containing compound, for example, β-thiodiglycol, thioglycol and the like, the dependency of the composition of the alloy plated coating on current density can not be sufficiently lowered.

Amount of Sulfur-containing Compound

In the alloy plating bath containing tin and copper of the present invention, the amount of the sulfur-containing compound in the plating bath is preferably about 0.001–2 mole/l, more preferably about 0.005–0.5 mole/l, in any of the tin-copper alloy plating bath, tin-copper-bismuth alloy plating bath and tin-copper-silver alloy plating bath.

Other Additives

The alloy plating bath containing tin and copper of the present invention may further contain a compound having two or more nitrogen-containing aromatic rings in its molecule, if necessary. The addition of such compound having nitrogen-containing aromatic rings to the plating bath improves the effect of preventing deposition of copper on the anode by substitution.

Examples of the compound having two or more nitrogen-containing aromatic rings in its molecule include 2,2'-bipyridyl, 5,5'-dimethyl-2,2'-bipyridyl, 4,4'-diethyl-2,2'-bipyridyl, 2,2':6',2"-terpyridine, 5,5'-diethyl-4,4'-dimethyl-2,2'-bipyridyl, 2,2'-bipyridyl-4,4'-biscarboxylic acid, 1,10-phenanthroline, 5-amino-1,10-phenanthroline, 4,7-dichloro-1,10-phenanthroline, 5-nitro-1,10-phenanthroline, 2-chloro-1,10-phenanthroline, 5-chloro-1,10-phenanthroline, 2-methyl-1,10-phenanthroline, 5-methyl-1,10-phenanthroline, 2,9-dimethyl-1,10-phenanthroline, 4,7-dimethyl-1,10-phenanthroline, 5,6-dimethyl-1,10-phenanthroline, 3,5,6,8-tetramethyl-1,10-phenanthroline, 4,7-diphenyl-1,10-phenanthroline, 2,9-dimethyl-4,7-diphenyl-1,10-phenanthroline, disodium salt of bathophenanthroline disulfonic acid, 2,4,6-tris(2-pyridyl)-1,3,5-triazine and the like.

The amount of the compound having two or more nitrogen-containing aromatic rings in its molecule to be added to the alloy plating bath containing tin and copper is preferably about 0.002–2 g/l, more preferably about 0.005–0.5 g/l.

The alloy plating bath containing tin and copper of the present invention may further contain an unsaturated aliphatic carboxylic compound, if necessary. The addition of the unsaturated aliphatic carboxylic compound to the plating bath improves the stability of the plating bath and prevents the occurrence of turbidness. It also improves the effect of preventing deposition of copper on the anode by substitution.

Examples of the unsaturated aliphatic carboxylic compound include acrylic acid, methacrylic acid, crotonic acid, isocrotonic acid, angelic acid, tiglic acid, maleic acid, fumaric acid, propiolic acid, tetrolic acid, acetylenedicarboxylic acid and like unsaturated carboxylic acids; esters of these unsaturated carboxylic acids such as methyl ester, ethyl ester, propyl ester, butyl ester, hydroxypropyl ester, glycerol ester, polyethylene glycol ester and polypropylene glycol ester; glycerol dimethacrylate, glyceryl diacrylate, polyethylene glycol dimethacrylate, polypropylene glycol dimethacrylate, polyethylene glycol diacrylate, polypropylene glycol diacrylate and the like.

The amount of the unsaturated aliphatic carboxylic compound to be added to the alloy plating bath containing tin and copper is preferably about 0.05–100 g/l, more preferably about 0.5–10 g/l.

In addition to the above components, the alloy plating bath containing tin and copper of the present invention may optionally contain conventionally known additives such as surfactants, antioxidants, brighteners, semibrighteners, complexing agents, pH adjusting agents, buffers and the like, depending on its object.

Useful surfactants include nonionic surfactants, anionic surfactants, cationic surfactants, amphoteric surfactants and the like. The surfactants may be used singly or in combination of two or more kinds. The amount of the surfactants to be added is preferably about 0.01–100 g/l, more preferably about 0.1–50 g/l.

The surfactant is used to improve the appearance, grain fineness, smoothness, adherence, throwing power, etc., of the plated coating. In particular, the surfactant and the above-mentioned sulfur-containing compound act synergistically to effectively lower the dependence of the composition of the plated coating on current density.

The nonionic surfactant for use in the present invention are alkylene oxide adducts which are obtained by addition condensation of 2–300 moles of at least one alkylene oxide selected from the group consisting of ethylene oxide (EO) and propylene oxide (PO) with a compound such as $C_1$–$C_{20}$ alkanol, phenol, naphthol, bisphenol, $C_1$–$C_{25}$ alkylphenol, arylalkylphenol, $C_1$–$C_{25}$ alkylnaphthol, $C_1$–$C_{25}$ alkoxylated phosphoric acid (its salt), sorbitan ester, styrenated phenol, polyalkylene glycol, $C_1$–$C_{30}$ aliphatic amine, $C_1$–$C_{22}$ aliphatic amide and the like.

Thus, the nonionic surfactants may be any of the adducts of EO only, PO only or both EO and PO of the above-mentioned alkanol, phenol, naphthol and like. Specifically, preferable are ethylene oxide adducts of α-naphthol or β-naphthol (i.e., α-naphthol polyethoxylate and the like).

Examples of the $C_1$–$C_{20}$ alkanol used for the addition condensation of the alkylene oxide include octanol, decanol, lauryl alcohol, tetradecanol, hexadecanol, stearyl alcohol, eicosanol, cetyl alcohol, oleyl alcohol, docosanol and the like.

Examples of the bisphenol used for the addition condensation of the alkylene oxide include bisphenol A, bisphenol B, bisphenol F and the like.

Examples of the $C_1$–$C_{25}$ alkylphenol used for the addition condensation of the alkylene oxide include mono, di or trialkyl-substituted phenol such as p-butylphenol, p-isooctylphenol, p-nonylphenol, p-hexylphenol, 2,4-dibutylphenol, 2,4,6-tributylphenol, p-dodecylphenol, p-laurylphenol, p-stearylphenol and the like.

Examples of the arylalkylphenol used for the addition condensation of the alkylene oxide include 2-phenylisopropylphenyl and the like.

Examples of the alkyl group of the $C_1$–$C_{25}$ alkylnaphthol used for the addition condensation of the alkylene oxide include methyl, ethyl, propyl, butyl, hexyl, octyl, decyl, dodecyl, octadecyl and the like. The alkyl group may be at any position of the naphthalene nucleus.

The $C_1$–$C_{25}$ alkoxylated phosphoric acid (salt) used for the addition condensation of the alkylene oxide is represented by the following formula (a).

$$Ra.Rb.(MO)P{=}O \qquad (a)$$

(in the formula (a), Ra and Rb are the same or different and each represents $C_1$–$C_{25}$ alkyl, either of which, however, may be H. M represents H or an alkaline metal.)

Examples of the sorbitan ester used for the addition condensation of the alkylene oxide include mono-, di- or tri-esterified 1,4-, 1,5- or 3,6-sorbitan such as sorbitan monolaurate, sorbitan monopalmitate, sorbitan distearate, sorbitan dioleate, sorbitan mixed fatty acid ester and the like.

Examples of the $C_1$–$C_{30}$ aliphatic amine used for the addition condensation of the alkylene oxide include propylamine, butylamine, hexylamine, octylamine, decylamine, laurylamine, stearylamine, oleylamine, behenylamine, docosenylamine, triacontylamine, dioleylamine, ethylenediamine, propylenediamine and like saturated or unsaturated aliphatic amine and the like.

Examples of the $C_1$–$C_{22}$ aliphatic amide used for the addition condensation of the alkylene oxide include amides of propionic acid, butyric acid, caprylic acid, capric acid, lauric acid, myristic acid, palmitic acid, stearic acid, behenic acid and the like.

Among the above nonionic surfactants, the alkylene oxide adducts of the $C_8$–$C_{30}$ aliphatic amine can particularly improve the effects of preventing copper substitution on the anode and stabilize the bath to prevent turbidness by using in combination with the aforementioned specific sulfur-containing compound or by using, in addition to the aforementioned specific sulfur-containing compound, in combination further with a compound having two or more nitrogen-containing aromatic rings in its molecule, unsaturated aliphatic carboxylic compound and the like.

Examples of the cationic surfactant include a quaternary ammonium salt represented by the following formula (b), a pyridinium salt represented by the following formula (c) and the like.

$$(R_1.R_2.R_3.R_4N)^+.X^- \quad (b)$$

(In the formula (b), X represents halogen, hydroxy, $C_1$–$C_5$ alkanesulfonic acid or sulfuric acid; $R_1$, $R_2$ and $R_3$ are the same or different and each represents $C_1$–$C_{20}$ alkyl; $R_4$ represents $C_1$–$C_{10}$ alkyl or benzyl.)

$$R_6—(C_6H_4N—R_5)^+.X^- \quad (c)$$

(In the formula (c), X represents halogen, hydroxy, $C_1$–$C_5$ alkane sulfonic acid or sulfuric acid; $R_5$ represents $C_1$–$C_{20}$ alkyl; $R_6$ represents H or $C_1$–$C_{10}$ alkyl.)

Examples of the cationic surfactants in the form of salts include lauryltrimethylammonium salt, stearyltrimethylammonium salt, lauryldimethylethylammonium salt, octadecyldimethylethylammonium salt, dimethylbenzyllaurylammonium salt, cethyldimethylbenzylammonium salt, octadecyldimethylbenzylammonium salt, trimethylbenzylammonium salt, triethylbenzylammonium salt, hexadecylpyridinium salt, laurylpyridinium salt, dodecylpyridinium salt, stearylamine acetate, laurylamine acetate, octadecylamine acetate and the like.

Examples of the anionic surfactants include alkylsulfate, polyoxyethylenealkyl ether sulfate, polyoxyethylenealkylphenyl ether sulfate, alkylbenzene-sulfonate, (mono, di, tri)alkylnaphthalenesulfonate and the like. Examples of the alkylsulfates include sodium laurylsufate, sodium oleylsulfate and the like. Examples of the polyoxyethylenealkyl ether sulfates include sodium polyoxyethylene (EO12) nonyl ether sulfate, sodium polyoxyethylene (EO15) dodecyl ether sulfate and the like. Examples of the polyoxyethylenealkylphenyl ether sulfates include polyoxyethylene (EO15) nonylphenyl ether sulfate and the like. Examples of the alkylbenzenesulfonate include sodium dodecylbenzenesulfonate and the like. Examples of the (mono, di, tri) alkylnaphthalenesulfonate include sodium dibutylnaphthalenesulfonate and the like.

Examples of the amphoteric surfactants include carboxybetaine, imidazoline betaine, sulfobetaine, aminocarboxylic acid and the like. Also useful are the sulfated or sulfonated adducts of the condensation products of ethylene oxide and/or propylene oxide with alkylamine or diamine.

Typical examples of the carboxybetaine or imidazoline betaine include lauryldimethylaminoacetatic acid betaine, myristyldimethylaminoacetatic acid betaine, stearyldimethylaminoacetatic acid betaine, cocoamidepropyldimethylaminoacetic acid betaine, 2-undecyl-1-carboxymethyl-1-hydroxyethylimidazolium betaine, 2-octyl-1-carboxymethyl-1-carboxyethylimidazolium betaine and the like. Examples of the sulfated or sulfonated adducts include sulfuric acid adducts of ethoxylated alkylamine, sodium salts of sulfonated lauric acid derivatives and the like.

Examples of the above sulfobetaine include cocoamidepropyldimethylammonium-2-hydroxypropanesulfonic acid, sodium N-cocoylmethyltaurine, sodium N-palmitoylmethyltaurine and the like.

Examples of the aminocarboxylic acid include dioctylaminoethylglycine, N-laurylaminopropionic acid, sodium salt of octyldi(aminoethyl)glycine and the like.

The antioxidants are used to prevent oxidation of tin in the bath. Examples of the antioxidants include ascorbic acid or its salt, hydroquinone, catechol, resorcin, phloroglucinol, cresolsulfonic acid or its salt, phenolsulfonic acid or its salt, naphtholsulfonic acid or its salt and the like.

Useful brighteners include m-chlorobenzaldehyde, p-nitrobenzaldehyde, p-hydroxybenzaldehyde, 1-naphthaldehyde, benzylidenealdehyde, salicylaldehyde, paraldehyde and like aldehyde, vanillin, triazine, imidazole, indole, quinoline, 2-vinylpyridine, aniline and the like.

Examples of the useful semibrighteners include thiourea compounds, N-(3-hydroxybutylidene)-p-sulfanilic acid, N-butylidenesulfanilic acid, N-cinnamoylidene-sulfanilic acid, 2,4-diamino-6-(2'-methylimidazolyl (1'))ethyl-1,3,5-triazine, 2,4-diamino-6-(2'-ethyl-4-methylimidazolyl(1'))ethyl-1,3,5-triazine, 2,4-diamino-6-(2'-undecylimidazolyl (1'))ethyl-1,3,5-triazine, phenyl salicylate, benzothiazole compounds and the like. Examples of the benzothiazole compounds include benzothiazole, 2-methylbenzothiazole, 2-(methyl-mercapto)benzothiazole, 2-aminobenzothiazole, 2-amino-6-methoxybenzothiazole, 2-methyl-5-chlorobenzothiazole, 2-hydroxybenzothiazole, 2-amino-6-methylbenzothiazole, 2-chlorobenzothiazole, 2,5-dimethylbenzothiazole, 2-mercaptobenzothiazole, 6-nitro-2-mercaptobenzothiazole, 5-hydroxy-2-methylbenzothiazole, 2-benzothiazolethioacetic acid and the like.

The complexing agents are used mainly for stabilizing and promoting the dissolution of copper in the bath. Examples of the useful complexing agents include gluconic acid, glucoheptonic acid, ethylenediamine, ethylenediaminetetraacetic acid (EDTA), diethylenetriaminepentaacetic acid (DTPA), nitrilotriacetic acid (NTA), iminodiacetic acid (IDA), iminodipropionic acid (IDP), hydroxyethylethylenediaminetriacetic acid (HEDTA), triethylenetetraminehexaacetic acid (TTHA), oxalic acid, citric acid, tartaric acid, Rochelle salt, lactic acid, malic acid, malonic acid, acetic acid, salts of these compounds, thiourea or its derivatives and the like.

Useful pH adjusting agents include hydrochloric acid, sulfuric acid and like acids, ammonium hydroxide, sodium hydroxide and like bases.

Useful buffers include boric acids, phosphoric acids, ammonium chloride and the like.

The concentration of the above additives in the alloy plating bath containing tin and copper of the present invention may be suitably selected depending on the method by which the plating bath is used, such as the barrel plating, rack plating, high-speed continuous plating, rackless plating and the like.

Plating Conditions

When electroplating is conducted with the alloy plating bath containing tin and copper of the present invention, the bath temperature is preferably about 0° C. or higher, more preferably about 10–50° C. The cathode current density is preferably about 0.01–150 A/dm$^2$, more preferably about 0.1–30 A/dm$^2$.

The pH of the bath may be in the broad range of acidic to approximately neutral, particularly preferably in the range of weakly acidic to strongly acidic.

The alloy plating bath containing tin and copper of the present invention is a lead-free plating bath. The plated coating formed from the plating bath of the invention has as high soldering strength as conventional tin-lead alloy coatings. Therefore, the alloy plating bath containing tin and copper of the invention is highly useful as a safe plating bath which is capable of forming a plated coating excellent in soldability especially when the article to be plated is an electrical part or electronic part. The electrical part or electronic part to be plated is not restricted, and may be, for example, semiconductor devices, connectors, switches, resistors, variable resistors, condensers, filters, inductors, thermistors, quartz resonators, lead wires, printed boards or the like. The thickness of the plated coating is not critical and usually about 1–20 μm.

The alloy plating bath containing tin and copper of the present invention produces the prominent effects described below.

(1) The alloy plating bath containing tin and copper of the invention can prevent the deposition of copper on the tin anode by substitution during electroplating. This is presumably because the sulfur-containing compound in the plating bath affects the copper salt in the bath and lowers the standard electrode potential of the copper, inhibiting the deposition of the copper on the tin anode by substitution.

In general, the copper salt concentration in the alloy plating bath containing tin and copper is adjusted to be lower than that of tin(II) salt. In the alloy plating bath containing tin and copper of the invention, however, the copper salt concentration in the bath can be appropriately maintained since the copper is hardly deposited on the tin anode. For this reason, unlike in conventional plating baths in which the proportion of the copper in the plated coating may be disadvantageously lowered due to the copper substitution on the anode, the alloy plating bath containing tin and copper of the invention improve the constancy of the Sn/Cu ratio in the plated coating without the supply of copper salt.

(2) The alloy plating bath containing tin and copper of the invention can form a plated coating having a constant composition at a current density widely ranging from low current density to high current density, providing an alloy plated coating containing tin and copper having low dependency of the plated coating composition on current density.

For instance, the alloy plating bath containing tin and copper of the invention can easily provide a highly practical tin-copper eutectic alloy containing 1.3 mole % of Cu.

(3) The alloy plating bath containing tin and copper of the present invention has a good stability with time and thus hardly becomes turbid even after about 1 month from the preparation of the bath.

The turbidness of the alloy plating bath containing tin and copper results from the oxidation of divalent tin into tetravalent, which presumably occurs in the following cycle. In the alloy plating bath containing tin and copper, $Cu^{2+}$ reacts with the tin salt to oxidize $Sn^{2+}$ to $Sn^{4+}$. The copper ions ($Cu^{+}$) reduced by the tin salt is oxidized to be $Cu^{2+}$ again by the reduction of oxygen which takes place at the same time with the oxidation of the tin. The resulting $Cu^{2+}$ again disadvantageously reacts with the $Sn^{2+}$ in the bath.

According to the alloy plating bath containing tin and copper of the present invention, the sulfur-containing compound in the bath stabilizes the copper salt. Hence, assumably, the copper ions do not react with $Sn^{2+}$ in the bath, whereby the oxidation of tin is inhibited and the turbidness of the bath is prevented.

(4) The tin-copper-silver alloy plating bath of the present invention comprises silver which is difficult to be stably dissolved in the bath. However, the bath does not decompose for a long period after the preparation of the bath, and can provide a plated coating having constant composition. This is presumably because the specific sulfur-containing compound used as an additive stabilizes the silver in the bath.

(5) When the alloy plating bath containing tin and copper of the present invention further comprises a compound having two or more nitrogen-containing aromatic rings in its molecule, the deposition of copper on the tin anode by substitution during electroplating can be prevented more effectively.

(6) When the alloy plating bath containing tin and copper of the present invention further comprises an unsaturated aliphatic carboxylic compound, the deposition of copper on the tin anode by substitution during electroplating can be prevented more effectively. In addition, the stability of the plating bath is improved and the bath is prevented from becoming turbid over a long period of time.

(7) When the alloy plating bath containing tin and copper of the present invention further comprises a surfactant, the formed plated coating is given greatly improved appearance, grain fineness, smoothness, adherence, throwing power and the like. Therefore, the commercial value of the plated product can be increased.

Particularly, the surfactant and the sulfur-containing compound, when used in combination, act synergistically to further lower the dependence of the composition of the alloy plated coating on current density.

(8) The plated coating formed from the alloy plating bath containing tin and copper of the present invention is a lead-free solder plated coating. Thus, the plated coating has little adverse effects on the human body and the environment. Additionally, the plated coating is a highly practical lead-free solder plating because of its high soldering strength and melting point similar to that of tin-lead alloy plating.

Furthermore, the tin-copper alloy plating is unlikely to form cracks and the tin-copper-bismuth alloy plating can effectively prevent the formation of both whiskers and cracks. Thus, these baths are prospective substitutes for the tin-lead alloy plating.

EXAMPLES

Given below are examples of tin- and copper-containing alloy plating baths including tin-copper alloy plating baths, tin-copper-silver alloy plating baths and tin-copper-bismuth alloy plating baths; and the results of testing current density dependency of the compositions of the electrodeposited coatings, capability of preventing substitution on the anode, coating appearance and bath stability with time.

In the following Examples and Comparative Examples, tin-copper alloy plating baths are classified as Group A, tin-copper-silver alloy plating baths as Group B, and tin-copper-bismuth alloy plating baths as Group C.

Examples of Tin-copper Alloy Plating Baths (Group A)

The Group A plating baths of tin-copper alloys presented in the following Examples contained, as a sulfur-containing compound, a basic nitrogen atom-containing sulfide compound represented by the formula (2) (Examples 1A to 3A and 13A); an aliphatic sulfide compound represented by the formula (1) (Examples 4A to 6A and 14A to 18A); a thiocrown ether compound (Examples 7A to 8A); thiourea or its derivative (Examples 9A to 10A); or a basic nitrogen atom-containing aliphatic or aromatic mercaptan compound (Examples 11A to 12A). Of these Examples, Example 11A shows a neutral bath. Examples 13A to 14A illustrate plating baths containing, in addition to the sulfur-containing compound, a compound having at least two nitrogen-containing aromatic rings, and an alkylene oxide adduct of a $C_8$ to $C_{30}$ aliphatic amine; Examples 15A, 16A and 18A illustrate plating baths containing, in addition to the sulfur-containing compound, a compound having at least two nitrogen-containing aromatic rings, alkylene oxide adducts of $C_8$ to $C_{30}$ aliphatic amines, and an unsaturated aliphatic carboxylic compound; and Example 17A shows a plating bath containing, in addition to the sulfur-containing compound, a compound having at least two nitrogen-containing aromatic rings, and an unsaturated aliphatic carboxylic compound.

Comparative Example 1A describes a plating bath not containing a sulfur-containing compound nor a surfactant; Comparative Example 2A, a plating bath containing a surfactant but not containing a sulfur-containing compound; and Comparative Example 3A, a plating bath described in Japanese Unexamined Patent Publication No. 1996-13185, which contained a nonionic surfactant but did not contain a sulfur-containing compound.

The compositions of the Group A plating baths are shown below.

Example 1A

| | |
|---|---|
| Tin(II) methanesulfonate (as $Sn^{2+}$) | 0.1974 mole/l |
| Copper sulfate (as $Cu^{2+}$) | 0.0026 mole/l |
| Methanesulfonic acid | 2 moles/l |
| 2,2'-Dipyridyl disulfide | 0.01 mole/l |
| α-Naphthol polyethoxylate (EO 10 moles) | 5 g/l |

Example 2A

| | |
|---|---|
| Tin(II) methanesulfonate (as $Sn^{2+}$) | 0.1974 mole/l |
| Copper sulfate (as $Cu^{2+}$) | 0.0026 mole/l |
| Methanesulfonic acid | 2 moles/l |
| 5,5'-Di(1,2,3-triazolyl)disulfide | 0.01 mole/l |
| α-Naphthol polyethoxylate (EO 10 moles) | 5 g/l |

Example 3A

| | |
|---|---|
| Tin(II) methanesulfonate (as $Sn^{2+}$) | 0.1974 mole/l |
| Copper sulfate (as $Cu^{2+}$) | 0.0026 mole/l |
| Methanesulfonic acid | 2 moles/l |
| 2-Pyridyl-2-aminophenyl disulfide | 0.01 mole/l |
| α-Naphthol polyethoxylate (EO 10 moles) | 5 g/l |

Example 4A

| | |
|---|---|
| Tin(II) methanesulfonate (as $Sn^{2+}$) | 0.2 mole/l |
| Copper methanesulfonate (as $Cu^{2+}$) | 0.005 mole/l |
| Methanesulfonic acid | 2 moles/l |
| Thiodiglycolic acid | 0.02 mole/l |
| Polyoxyethylene nonylphenyl ether (EO 15 moles) | 5 g/l |
| Hydroquinone | 1 g/l |

Example 5A

| | |
|---|---|
| Tin(II) methanesulfonate (as $Sn^{2+}$) | 0.2 mole/l |
| Copper methanesulfonate (as $Cu^{2+}$) | 0.005 mole/l |
| Methanesulfonic acid | 2 moles/l |
| Thiobis(dodecaethylene glycol) | 0.02 mole/l |
| Polyoxyethylene nonylphenyl ether (EO 15 moles) | 5 g/l |
| Hydroquinone | 1 g/l |

Example 6A

| | |
|---|---|
| Tin(II) methanesulfonate (as $Sn^{2+}$) | 0.2 mole/l |
| Copper methanesulfonate (as $Cu^{2+}$) | 0.005 mole/l |
| Methanesulfonic acid | 2 moles/l |
| Thiobis(triglycerine) | 0.02 mole/l |
| Polyoxyethylene nonylphenyl ether (EO 15 moles) | 5 g/l |
| Hydroquinone | 1 g/l |

Example 7A

| | |
|---|---|
| Tin(II) sulfate (as $Sn^{2+}$) | 0.1974 mole/l |
| Copper sulfate (as $Cu^{2+}$) | 0.0026 mole/l |
| Sulfuric acid | 1 mole/l |
| 1,10-Diaza-4,7,13,16-tetrathiacyclooctadecane | 0.01 mole/l |
| Laurylamine polyethoxylate (EO 10 moles)-polypropoxylate (PO 3 moles) | 7 g/l |
| Catechol | 1 g/l |

Example 8A

| | |
|---|---|
| Tin(II) sulfate (as $Sn^{2+}$) | 0.1974 mole/l |
| Copper sulfate (as $Cu^{2+}$) | 0.0026 mole/l |
| Sulfuric acid | 1 mole/l |
| 1-Aza-4,7,11,14-tetrathiacyclohexadecane | 0.01 mole/l |
| Laurylamine polyethoxylate (EO 10 moles)-polypropoxylate (PO 3 moles) | 7 g/l |
| Catechol | 1 g/l |

Example 9A

| | |
|---|---|
| Tin(II) ethanesulfonate (as $Sn^{2+}$) | 0.1974 mole/l |
| Copper sulfate (as $Cu^{2+}$) | 0.0026 mole/l |
| Ethanesulfonic acid | 2 moles/l |
| Thiourea | 0.01 mole/l |
| Tristyrenated phenol polyethoxylate (EO 15 moles)-polypropoxylate (PO 3 moles) | 7 g/l |
| Hydroquinone | 1 g/l |

Example 10A

| | |
|---|---|
| Tin(II) ethanesulfonate (as $Sn^{2+}$) | 0.1974 mole/l |
| Copper sulfate (as $Cu^{2+}$) | 0.0026 mole/l |
| Ethanesulfonic acid | 2 moles/l |
| 1,3-Dimethylthiourea | 0.01 mole/l |
| Tristyrenated phenol polyethoxylate (EO 15 moles)-polypropoxylate (PO 3 moles) | 7 g/l |
| Hydroquinone | 1 g/l |

Example 11A

| | |
|---|---|
| Tin(II) sulfate (as $Sn^{2+}$) | 0.1974 mole/l |
| Copper sulfate (as $Cu^{2+}$) | 0.0026 mole/l |
| Sulfuric acid | 1 mole/l |
| Sodium gluconate | 250 g/l |
| Acetylcysteine | 0.01 mole/l |

-continued

| | |
|---|---|
| Laurylamine polyethoxylate (EO 10 moles)-polypropoxylate (PO 3 moles) | 7 g/l |
| Catechol | 1 g/l |
| (Adjusted to pH 5 with NaOH) | |

Example 12A

| | |
|---|---|
| Tin(II) methanesulfonate (as $Sn^{2+}$) | 0.1974 mole/l |
| Copper sulfate (as $Cu^{2+}$) | 0.0026 mole/l |
| Methanesulfonic acid | 2 moles/l |
| 5-Mercapto-1,3,4-triazole | 0.01 mole/l |
| α-Naphthol polyethoxylate (EO 10 moles) | 5 g/l |

Example 13A

| | |
|---|---|
| Tin(II) methanesulfonate (as $Sn^{2+}$) | 0.08 mole/l |
| Copper methanesulfonate (as $Cu^{2+}$) | 0.0018 mole/l |
| Methanesulfonic acid | 1 mole/l |
| 4,4'-Dipyridyl disulfide | 0.01 mole/l |
| 1,10-Phenanthroline | 0.02 g/l |
| Laurylamine polyethoxylate (EO 12 moles) | 10 g/l |

Example 14A

| | |
|---|---|
| Tin(II) methanesulfonate (as $Sn^{2+}$) | 0.165 mole/l |
| Copper methanesulfonate (as $Cu^{2+}$) | 0.007 mole/l |
| Methanesulfonic acid | 2 mole/l |
| 3,6-Dithiaoctane-1,8-diol | 0.05 mole/l |
| 2,2'-Bipyridyl | 0.04 g/l |
| Oleylamine polyethoxylate (EO 15 moles) | 8 g/l |

Example 15A

| | |
|---|---|
| Tin(II) methanesulfonate (as $Sn^{2+}$) | 0.08 mole/l |
| Copper methanesulfonate (as $Cu^{2+}$) | 0.0018 mole/l |
| Methanesulfonic acid | 2 moles/l |
| Thiobis(dodecaethylene glycol) | 0.03 mole/l |
| Methacrylic acid | 4 g/l |
| Neocuproine | 0.02 g/l |
| β-Naphthol polyethoxylate (EO 13 moles) | 5 g/l |
| Laurylamine polyethoxylate (EO 12 moles) | 10 g/l |

Example 16A

| | |
|---|---|
| Tin(II) methanesulfonate (as $Sn^{2+}$) | 0.08 mole/l |
| Copper methanesulfonate (as $Cu^{2+}$) | 0.0035 mole/l |
| Methanesulfonic acid | 2 moles/l |
| 3,6-Dithiaoctane-1,8-diol | 0.02 mole/l |
| 1-Naphthaldehyde | 0.25 g/l |
| Methacrylic acid | 4 g/l |
| β-Naphthol polyethoxylate (EO 13 moles) | 5 g/l |
| Oleylamine polyethoxylate (EO 12 moles) | 20 g/l |
| 2,2-Bipyridyl | 0.03 g/l |

Example 17A

| | |
|---|---|
| Tin(II) methanesulfonate (as $Sn^{2+}$) | 0.08 mole/l |
| Copper methanesulfonate (as $Cu^{2+}$) | 0.0035 mole/l |
| Methanesulfonic acid | 1.2 moles/l |
| 1,2-Ethanedithiol-bis(dodecaethylene glycol)thioether | 0.02 mole/l |
| Propiolic acid | 3 g/l |
| Bisphenol A polyethoxylate (EO 17 moles) | 20 g/l |
| 2,2'-Bipyridyl | 0.05 g/l |

Example 18A

| | |
|---|---|
| Tin(II) methanesulfonate (as $Sn^{2+}$) | 0.5 mole/l |
| Copper methanesulfonate (as $Cu^{2+}$) | 0.018 mole/l |
| Methanesulfonic acid | 1.3 mole/l |
| 1,5-Dimercapto-3-thiapentane-bis(hexadecaethylene glycol) | 0.08 mole/l |
| 2,2'-Bipyridyl | 0.02 g/l |
| 1-Naphthaldehyde | 0.2 g/l |
| Methacrylic acid | 4 g/l |
| β-Naphthol polyethoxylate (EO 13 moles) | 2 g/l |
| Tristyrenated phenol polyethoxylate (EO 20 moles) | 5 g/l |
| Laurylamine polyethoxylate (EO 15 moles) | 5 g/l |
| Catechol | 0.8 g/l |
| Hydroquinone | 0.8 g/l |

Comparative Example 1A

| | |
|---|---|
| Tin(II) methanesulfonate (as $Sn^{2+}$) | 0.1974 mole/l |
| Copper sulfate (as $Cu^{2+}$) | 0.0026 mole/l |
| Methanesulfonic acid | 2 moles/l |

Comparative Example 2A

| | |
|---|---|
| Tin(II) methanesulfonate (as $Sn^{2+}$) | 0.1974 mole/l |
| Copper sulfate (as $Cu^{2+}$) | 0.0026 mole/l |
| Methanesulfonic acid | 2 moles/l |
| α-Naphthol polyethoxylate (EO 10 moles) | 5 g/l |

Comparative Example 3A

| | |
|---|---|
| Tin(II) methanesulfonate (as $Sn^{2+}$) | 40 g/l |
| Copper methanesulfonate (as $Cu^{2+}$) | 0.2 g/l |
| Methanesulfonic acid | 120 g/l |
| Ethylene oxide adduct of octylphenol ethoxylate (EO 10 moles) | 7 g/l |

The above plating baths were tested for current density dependency, capability of preventing substitution on the anode, coating appearance and bath stability with time, by the methods described below. Table 1 shows the results.

<Current Density Dependency Test>

Using the plating baths at a bath temperature of 25° C., nickel substrates were electroplated under the following cathode current density condition (1) or (2).

Condition (1): at 0.5 A/dm$^2$ for 20 minutes

Condition (2): at 3 A/dm$^2$ for 3 minutes and 20 seconds

The plated coatings formed were dissolved and subjected to inductively coupled plasma emission spectrometry (ICP) to determine the Sn/Cu ratios in the plated coatings.

<Test for Capability of Preventing Substitution on the Anode>

In 1 liter of each plating solution was submerged a tin sheet having a surface area of 0.5 $dm^2$ at room temperature for 1 day. Thereafter, the remaining proportion of the copper salt in the solution was calculated according to the following equation, and used as an index of the capability of preventing deposition of copper by substitution on a tin anode.

$$\text{Remaining proportion of copper salt} = \frac{Cu^{2+}\text{ content after submersion of Sn}}{\text{Initial } Cu^{2+}\text{ content of the solution}}$$

<Coating Appearance Test>

The surface conditions of the electrodeposited coatings formed using the above plating baths were visually inspected, and evaluated according to the following criteria.

A: The coating surface had uniform white color.

B: The coating surface had mottled grayish color.

<Test for Bath Stability with Time>

The plating baths were allowed to stand at room temperature for 1 month after preparation. Then, the absorbances of the baths were measured with an absorptiometer at 660 nm, using pure water as a control, to thereby determine the turbidity of the baths.

TABLE 1

| Sn—Cu plating bath | Cu content of the coating (%) 0.5 A/$dm^2$ | 3 A/$dm^2$ | Capability of preventing substitution on anode (Remaining proportion of copper salt) | Coating appearance | Bath stability with time 660 nm |
|---|---|---|---|---|---|
| Ex. 1A | 1.2 | 1.2 | 0.96 | A | 0.005 |
| Ex. 2A | 1.3 | 1.3 | 0.97 | A | 0.001 |
| Ex. 3A | 1.2 | 1.1 | 0.89 | A | 0.003 |
| Ex. 4A | 2.5 | 2.5 | 0.81 | A | 0.005 |
| Ex. 5A | 2.4 | 2.3 | 0.87 | A | 0.007 |
| Ex. 6A | 2.5 | 2.3 | 0.87 | A | 0.006 |
| Ex. 7A | 1.1 | 1.0 | 0.95 | A | 0.003 |
| Ex. 8A | 1.2 | 1.0 | 0.96 | A | 0.003 |
| Ex. 9A | 1.1 | 1.0 | 0.81 | A | 0.003 |
| Ex. 10A | 1.3 | 1.1 | 0.83 | A | 0.005 |
| Ex. 11A | 1.1 | 1.2 | 0.99 | A | 0.004 |
| Ex. 12A | 1.2 | 1.1 | 0.89 | A | 0.003 |
| Ex. 13A | 1.0 | 1.1 | 0.96 | A | 0.005 |
| Ex. 14A | 2.1 | 2.2 | 0.99 | A | 0.001 |
| Ex. 15A | 1.1 | 1.0 | 0.95 | A | 0.003 |
| Ex. 16A | 2 | 2.1 | 0.99 | A | 0.001 |
| Ex. 17A | 2.2 | 2.1 | 0.97 | A | 0.002 |
| Ex. 18A | 1.1 (10 A/$dm^2$) | 1.2 (15 A/$dm^2$) | 0.98 | A | 0.003 |
| Comp. Ex. 1A | 38.5 | 2.7 | 0.01 | B | 0.7 |
| Comp. Ex. 2A | 7.8 | 2.7 | 0.01 | B | 0.8 |
| Comp. Ex. 3A | 12.3 | 0.7 | 0.01 | B | 0.8 |

Table 1 reveals the following.

(1) Current Density Dependency Test

When using the plating baths of Example 1A to 17A, the electrodeposited coatings formed at a low current density of 0.5 A/$dm^2$ were substantially equal in Sn/Cu ratio to those formed at a high current density of 3 A/$dm^2$, demonstrating that the compositions of the coatings had very low dependency on the current density. Further, the tin-copper alloy plated coatings obtained using plating baths of these Examples were similar in metal ratio to the respective plating baths, so that a tin-copper eutectic coating containing 1.3 mole % of copper or a coating having a composition similar to the eutectic composition can be formed by adjusting the compositions of the baths. In Examples 4A to 6A, 14A, 16A and 17A, the baths had a higher copper content than the baths of other Examples, resulting in coatings having a higher copper content of 2 to 2.5 mole %.

In contrast, each of the electrodeposited coatings obtained using the plating baths of Comparative Examples 1A to 3A which did not contain a sulfur-containing compound, greatly varies in composition at the low current density and at the high current density. Thus, it was confirmed that the compositions of these coatings were highly dependent on the current density. In particular, in the plating bath of Comparative Example 1A containing no surfactant, copper was priorly deposited at the low current density. The plating baths of Comparative Examples 2A to 3A contained a nonionic surfactant. Among them, the plating bath of Comparative Example 3A was prepared according to a working example of Japanese Unexamined Patent Publication No. 1996-13185. These Comparative Examples showed that surfactants alone cannot sufficiently reduce the current density dependency of the compositions of the plated coatings.

(2) Test for Capability of Preventing Substitution on the Anode

The plating baths of Examples 1A to 18A containing a sulfur-containing compound retained a large proportion of the copper salt, and underwent little change in the copper salt content, showing that these baths caused substantially no deposition of copper by substitution on the anode.

On the other hand, the plating baths of Comparative Examples 1A to 2A which did not contain a sulfur-containing compound retained a small amount of copper salt, and found to be incapable of sufficiently preventing substitution of copper on the anode.

(3) Coating Appearance

The coatings obtained using the plating baths of Examples 1A to 18A were all evaluated as A, whereas the coatings obtained using the plating baths of the Comparative Examples were inferior in appearance. In particular, the coating formed using the plating bath of Comparative Example 1A had a dendritic surface and was not suitable for practical use.

(4) Test for Bath Stability with Time

All of the plating baths of Examples 1A to 18A had an extremely small absorbance, indicating that they have high transparency with substantially no turbidity. In contrast, the plating baths of the Comparative Examples exhibited an absorbance which was orders of magnitudes greater than the absorbances of the baths of the Examples, indicating their higher turbidity.

Examples of Tin-copper-silver Alloy Plating Baths (Group B)

The Group B plating baths of tin-copper-silver alloys presented in the following Examples contained, as a sulfur-containing compound, a basic nitrogen atom-containing aliphatic mercaptan compound (Example 1B); a basic nitrogen atom-containing aromatic mercaptan compound (Example 2B); a basic nitrogen atom-containing sulfide compound represented by the formula (2) (Examples 3B to 4B); an aliphatic sulfide compound represented by the formula (1) (Examples 5B and 8B); a basic nitrogen atom-containing aliphatic mercaptan compound and an aromatic sulfide compound (Example 6B); or a thiocrown ether compound (Example 7B). Of these Examples, Example 8B illustrates a plating bath containing, in addition to the sulfur-containing compound, a compound having at least two nitrogen-containing aromatic rings, and alkylene oxide adducts of $C_8$ to $C_{30}$ aliphatic amines.

Comparative Example 1B describes a plating bath not containing a sulfur-containing compound; Comparative Example 2B, a plating bath disclosed in Japanese Unexamined Patent Publication No. 1997-143786 and containing a sulfide compound other than the specific sulfur-containing compounds for use in the present invention; and Comparative Example 3B, a plating bath containing an aliphatic mercaptan compound without a basic nitrogen atom.

The compositions of the Group B plating baths are shown below.

Example 1B

| | |
|---|---|
| Tin(II) chloride (as $Sn^{2+}$) | 0.1924 mole/l |
| Copper sulfate (as $Cu^{2+}$) | 0.0026 mole/l |
| Silver acetate (as $Ag^{+}$) | 0.0076 mole/l |
| L-tartaric acid | 1.0 mole/l |
| Aacetylcysteine | 0.2 mole/l |
| (Adjusted to pH 8 with NaOH) | |

Example 2B

| | |
|---|---|
| Tin(II) chloride (as $Sn^{2+}$) | 0.1924 mole/l |
| Copper sulfate (as $Cu^{2+}$) | 0.0026 mole/l |
| Silver acetate (as $Ag^{+}$) | 0.0076 mole/l |
| L-tartaric acid | 1.0 mole/l |
| 5-Mercapto-1,3,4-triazole | 0.2 mole/l |
| (Adjusted to pH 8 with NaOH) | |

Example 3B

| | |
|---|---|
| Tin(II) methanesulfonate (as $Sn^{2+}$) | 0.2 mole/l |
| Copper methanesulfonate (as $Cu^{2+}$) | 0.0025 mole/l |
| Silver methanesulfonate (as $Ag^{+}$) | 0.01 mole/l |
| Methanesulfonic acid | 1.0 mole/l |
| 2,2'-Dithiodianiline | 0.02 mole/l |
| α-Naphthol polyethoxylate (EO 10 moles) | 5 g/l |

Example 4B

| | |
|---|---|
| Tin(II) methanesulfonate (as $Sn^{2+}$) | 0.2 mole/l |
| Copper methanesulfonate (as $Cu^{2+}$) | 0.0025 mole/l |
| Silver methanesulfonate (as $Ag^{+}$) | 0.01 mole/l |
| Methanesulfonic acid | 1.0 mole/l |
| 2,2'-Dipyridyl disulfide | 0.02 mole/l |
| α-Naphthol polyethoxylate (EO 10 moles) | 5 g/l |

Example 5B

| | |
|---|---|
| Tin(II) methanesulfonate (as $Sn^{2+}$) | 0.2 mole/l |
| Copper methanesulfonate (as $Cu^{2+}$) | 0.0025 mole/l |
| Silver methanesulfonate (as $Ag^{+}$) | 0.01 mole/l |
| Methanesulfonic acid | 1.0 mole/l |

-continued

| | |
|---|---|
| Thiobis(dodecaethylene glycol) | 0.02 mole/l |
| α-Naphthol polyethoxylate (EO 10 moles) | 5 g/l |

Example 6B

| | |
|---|---|
| Tin(II) methanesulfonate (as $Sn^{2+}$) | 0.2 mole/l |
| Copper methanesulfonate (as $Cu^{2+}$) | 0.0025 mole/l |
| Silver methanesulfonate (as $Ag^{+}$) | 0.01 mole/l |
| Methanesulfonic acid | 1.0 mole/l |
| Acetylcysteine | 0.2 mole/l |
| 2,2'-Dithiodianiline | 0.02 mole/l |
| α-Naphthol polyethoxylate (EO 6.7 moles) | 5 g/l |

Example 7B

| | |
|---|---|
| Tin(II) methanesulfonate (as $Sn^{2+}$) | 0.2 mole/l |
| Copper methanesulfonate (as $Cu^{2+}$) | 0.0025 mole/l |
| Silver methanesulfonate (as $Ag^{+}$) | 0.01 mole/l |
| Methanesulfonic acid | 1.0 mole/l |
| 1,10-Diaza-4,7,13,16-tetrathiacyclohexadecane | 0.02 mole/l |
| α-Naphthol polyethoxylate (EO 10 moles) | 5 g/l |

Example 8B

| | |
|---|---|
| Tin(II) methanesulfonate (as $Sn^{2+}$) | 0.165 mole/l |
| Copper methanesulfonate (as $Cu^{2+}$) | 0.007 mole/l |
| Silver methanesulfonate (as $Ag^{+}$) | 0.01 mole/l |
| Methanesulfonic acid | 2 moles/l |
| 1,3-Propanedithiol-bis(decaethylene glycol)thioether | 0.1 mole/l |
| 4,4'-Bipyridyl | 0.02 g/l |
| β-Naphthol polyethoxylate (EO 13 moles) | 5 g/l |
| Laurylamine polyethoxylate (EO 12 moles) | 10 g/l |

Comparative Example 1B

| | |
|---|---|
| Tin(II) methanesulfonate (as $Sn^{2+}$) | 0.2 mole/l |
| Copper methanesulfonate (as $Cu^{2+}$) | 0.0025 mole/l |
| Silver methanesulfonate (as $Ag^{+}$) | 0.01 mole/l |
| Methanesulfonic acid | 1.0 mole/l |
| α-Naphthol polyethoxylate (EO 10 moles) | 5 g/l |

Comparative Example 2B

| | |
|---|---|
| Tin(II) methanesulfonate (as $Sn^{2+}$) | 20 g/l |
| Copper methanesulfonate (as $Cu^{2+}$) | 20 g/l |
| Silver methanesulfonate (as $Ag^{+}$) | 1 g/l |
| Methanesulfonic acid | 80 g/l |
| β-Thiodiglycol | 4 g/l |
| Sodium N,N'-diethyldithiocarbamate | 4 g/l |
| Ethylene oxide adduct of lauryl ether (EO 15 moles) | 5 g/l |

Comparative Example 3B

| | |
|---|---|
| Tin(II) methanesulfonate (as $Sn^{2+}$) | 0.2 mole/l |
| Copper methanesulfonate (as $Cu^{2+}$) | 0.0025 mole/l |
| Silver methanesulfonate (as $Ag^{+}$) | 0.01 mole/l |
| Methanesulfonic acid | 1.0 mole/l |
| Thioglycol | 0.02 mole/l |
| α-Naphthol polyethoxylate (EO 10 moles) | 5 g/l |

The above plating baths were tested for current density dependency, coating appearance and bath stability with time, by the same methods as for the Group A plating baths. Table 2 shows the results.

TABLE 2

| Sn—Cu—Ag plating bath | Current density ($A/dm^2$) | Content in the coating (%) Cu | Content in the coating (%) Ag | Coating appearance | Bath stability with time 660 nm |
|---|---|---|---|---|---|
| Ex. 1B | 0.5 | 0.7 | 3.3 | A | 0.003 |
| | 3.0 | 0.6 | 3.2 | | |
| Ex. 2B | 0.5 | 0.7 | 3.3 | A | 0.002 |
| | 3.0 | 0.7 | 3.2 | | |
| Ex. 3B | 0.5 | 1.1 | 3.6 | A | 0.007 |
| | 3.0 | 1.0 | 3.5 | | |
| Ex. 4B | 0.5 | 1.2 | 3.7 | A | 0.005 |
| | 3.0 | 1.1 | 3.5 | | |
| Ex. 5B | 0.5 | 1.3 | 3.2 | A | 0.001 |
| | 3.0 | 1.1 | 3.0 | | |
| Ex. 6B | 0.5 | 1.0 | 3.5 | A | 0.007 |
| | 3.0 | 1.0 | 3.5 | | |
| Ex. 7B | 0.5 | 1.3 | 2.7 | A | 0.006 |
| | 3.0 | 1.2 | 2.6 | | |
| Ex. 8B | 0.5 | 2.2 | 3.3 | A | 0.003 |
| | 3.0 | 2.1 | 3.1 | | |
| Comp. Ex. 1B | 0.5 | — | — | — | 0.8 |
| | 3.0 | — | — | | |
| Comp. Ex. 2B | 0.5 | 7.2 | 14.8 | B | 0.03 |
| | 3.0 | 0.6 | 0.9 | | |
| Comp. Ex. 3B | 0.5 | 5.3 | 10.5 | B | 0.05 |
| | 3.0 | 0.9 | 1.8 | | |

Table 2 reveals the following.

(1) Current Density Dependency Test

When using the plating baths of Examples 1B to 8B, the electrodeposited coatings formed at a low current density of 0.5 $A/dm^2$ were substantially equal in Sn/Cu/Ag ratio to those formed at a high current density of 3 $A/dm^2$, demonstrating the extremely low dependency of the Sn/Cu/Ag ratios in the electrodeposited coatings on the current density.

In contrast, the plating bath of Comparative Example 1B, which did not contain a sulfur-containing compound, decomposed immediately after preparation of the bath, thus was not usable for electroplating. The decomposition is presumably attributable to the absence of a sulfur-containing compound having an action to stabilize the silver salt in the bath. The plating bath of Comparative Example 2B was one described in a working example of Japanese Unexamined Patent Publication No. 1997-143786 and containing β-thiodiglycol, which is different from the specific sulfur-containing compounds for use in the present invention. The coating formed using the plating bath of Comparative Example 2B greatly varied in composition at the high current density and at the low current density, showing that the composition of the coating was highly dependent on the current density. Similarly, when using the bath of Comparative Example 3B containing a mercaptan compound (thioglycol) without a basic nitrogen atom, the composition of the resulting coating exhibited high current density dependency.

In view of the above results, the electrodeposited coatings obtained using the tin-copper-silver alloy plating baths of Examples 1B to 8B were remarkably lower in current density dependency of the Sn/Cu/Ag ratio, than the coatings obtained using the plating baths of the Comparative Examples. Thus, it was confirmed that use of a specific sulfur-containing compound greatly contributes to reduction of the current density dependency.

(2) Coating Appearance Test

The coatings formed using the plating baths of Examples 1B to 8B were all evaluated as A, whereas the coatings formed using the plating baths of the Comparative Examples were inferior in appearance. The plating bath of Comparative Example 1B decomposed immediately after preparation, thus was not usable for electroplating.

(3) Test for Bath Stability with Time

The plating baths of Examples 1B to 8B all had an extremely low absorbance. Namely, they had high transparency with substancially no turbidity. The plating baths of Comparative Examples 2B and 3B had a higher absorbance than the baths of the Examples, showing that they had higher turbidity.

Examples of Tin-copper-bismuth Alloy Plating Baths (Group C)

The Group C plating baths of tin-copper-bismuth alloys presented in the following Examples contained, as a sulfur-containing compound, a basic nitrogen atom-containing sulfide compound represented by the formula (2) (Examples 1C and 3C); an aliphatic sulfide compound represented by the formula (1) (Examples 2C, 8C and 9C); a basic nitrogen atom-containing aromatic mercaptan compound (Example 6C); a mercaptan compound without a basic nitrogen atom (Examples 4C and 5C); or thioiurea (Example 7C). Of these Examples, Examples 8C and Example 9C illustrate plating baths containing, in addition to the sulfur-containing compound, a compound having at least two nitrogen-containing aromatic rings, and an alkylene oxide adduct(s) of $C_8$ to $C_{30}$ aliphatic amine(s).

Comparative Examples 1C and 2C describe plating baths not containing a sulfur-containing compound.

The compositions of the Group C plating baths are shown below.

Example 1C

| | |
|---|---|
| Tin(II) methanesulfonate (as $Sn^{2+}$) | 0.2 mole/l |
| Copper methanesulfonate (as $Cu^{2+}$) | 0.0025 mole/l |
| Bismuth methanesulfonate (as $Bi^{3+}$) | 0.01 mole/l |
| Methanesulfonic acid | 1.5 moles/l |
| 2,2'-Dithiodianiline | 0.02 mole/l |

Example 2C

| | |
|---|---|
| Tin(II) methanesulfonate (as $Sn^{2+}$) | 0.2 mole/l |
| Copper methanesulfonate (as $Cu^{2+}$) | 0.0025 mole/l |
| Bismuth methanesulfonate ($Bi^{3+}$) | 0.01 mole/l |
| Methanesulfonic acid | 1.5 moles/l |
| Thiobis(dodecaethylene glycol) | 0.02 mole/l |

Example 3C

| | |
|---|---|
| Tin(II) methanesulfonate (as $Sn^{2+}$) | 0.2 mole/l |
| Copper methanesulfonate (as $Cu^{2+}$) | 0.0025 mole/l |
| Bismuth methanesulfonate (as $Bi^{3+}$) | 0.01 mole/l |
| Methanesulfonic acid | 1.5 moles/l |
| 2,2'-Dipyridyl disulfide | 0.02 mole/l |

Example 4C

| | |
|---|---|
| Tin(II) chloride (as $Sn^{2+}$) | 0.1924 mole/l |
| Copper sulfate (as $Cu^{2+}$) | 0.0025 mole/l |
| Bismuth sulfate (as $Bi^{3+}$) | 0.02 mole/l |
| Sulfuric acid | 1.0 mole/l |
| Acetylcysteine | 0.2 mole/l |

Example 5C

| | |
|---|---|
| Tin(II) chloride (as $Sn^{2+}$) | 0.1924 mole/l |
| Copper sulfate (as $Cu^{2+}$) | 0.0025 mole/l |
| Bismuth sulfate (as $Bi^{3+}$) | 0.02 mole/l |
| Sulfuric acid | 1.0 mole/l |
| Thioglycolic acid | 0.2 mole/l |

Example 6C

| | |
|---|---|
| Tin(II) methanesulfonate (as $Sn^{2+}$) | 0.2 mole/l |
| Copper methanesulfonate (as $Cu^{2+}$) | 0.0025 mole/l |
| Bismuth methanesulfonate (as $Bi^{3+}$) | 0.01 mole/l |
| Methanesulfonic acid | 1.5 moles/l |
| 5-Mercapto-1,3,4-triazole | 0.02 mole/l |

Example 7C

| | |
|---|---|
| Tin(II) methanesulfonate (as $Sn^{2+}$) | 0.2 mole/l |
| Copper methanesulfonate (as $Cu^{2+}$) | 0.0025 mole/l |
| Bismuth methanesulfonate ($Bi^{3+}$) | 0.01 mole/l |
| Methanesulfonic acid | 1.5 moles/l |
| Thiourea | 0.02 mole/l |

Example 8C

| | |
|---|---|
| Tin(II) methanesulfonate (as $Sn^{2+}$) | 0.165 mole/l |
| Copper methanesulfonate (as $Cu^{2+}$) | 0.007 mole/l |
| Bismuth methanesulfonate (as $Bi^{3+}$) | 0.008 mole/l |
| Methanesulfonic acid | 2 moles/l |
| 1,4-Bis(2-hydroxyethylthio)butane | 0.07 mole/l |
| 2,2':6',2"-Terpyridine | 0.02 g/l |
| Laurylamine polyethoxylate (EO 12 moles) | 10 g/l |

Example 9C

| | |
|---|---|
| Tin(II) methanesulfonate (as $Sn^{2+}$) | 0.08 mole/l |
| Copper methanesulfonate (as $Cu^{2+}$) | 0.0035 mole/l |
| Bismuth methanesulfonate (as $Bi^{3+}$) | 0.004 mole/l |
| Methanesulfonic acid | 2 moles/l |
| 4,7-Dithiadecane-1,2,9,10-tetraol | 0.03 mole/l |
| Benzalacetone | 0.25 g/l |
| 5,5'-Dimethyl-2,2'-bipyridyl | 0.1 g/l |
| Laurylamine polyethoxylate (EO 12 moles) | 10 g/l |
| Tristyrenated phenol polyethoxylate (EO 20 moles)-polypropoxylate (PO 2 moles) | 5 g/l |

Comparative Example 1C

| | |
|---|---|
| Tin(II) methanesulfonate (as $Sn^{2+}$) | 0.2 mole/l |
| Copper methanesulfonate (as $Cu^{2+}$) | 0.0025 mole/l |
| Bismuth methanesulfonate (as $Bi^{3+}$) | 0.01 mole/l |
| Methanesulfonic acid | 1.5 moles/l |

Comparative Example 2C

| | |
|---|---|
| Tin(II) chloride (as $Sn^{2+}$) | 0.1924 mole/l |
| Copper sulfate (as $Cu^{2+}$) | 0.0025 mole/l |
| Bismuth sulfate (as $Bi^{3+}$) | 0.02 mole/l |
| Sulfuric acid | 1.0 mole/l |

The above plating baths were tested for current density dependency, coating appearance and bath stability with time, by the same methods as for the Group A plating baths. Table 3 shows the results.

TABLE 3

| Sn-Cu-Bi plating bath | Current density ($A/dm^2$) | Content in the coating (%) Cu | Content in the coating (%) Bi | Coating appearance | Bath stability with time 660 nm |
|---|---|---|---|---|---|
| Ex. 1C | 0.5 | 1.1 | 2.5 | A | 0.004 |
| | 3.0 | 1.0 | 2.4 | | |
| Ex. 2C | 0.5 | 1.2 | 2.6 | A | 0.004 |
| | 3.0 | 1.1 | 2.5 | | |
| Ex. 3C | 0.5 | 1.2 | 2.5 | A | 0.006 |
| | 3.0 | 1.2 | 2.4 | | |
| Ex. 4C | 0.5 | 1.0 | 3.2 | A | 0.007 |
| | 3.0 | 0.9 | 3.1 | | |
| Ex. 5C | 0.5 | 0.7 | 2.4 | A | 0.003 |
| | 3.0 | 0.7 | 2.3 | | |
| Ex. 6C | 0.5 | 0.7 | 2.5 | A | 0.005 |
| | 3.0 | 0.6 | 2.5 | | |
| Ex. 7C | 0.5 | 0.7 | 2.8 | A | 0.007 |
| | 3.0 | 0.7 | 2.5 | | |
| Ex. 8C | 0.5 | 2.2 | 1.1 | A | 0.005 |
| | 3.0 | 2.1 | 1.0 | | |
| Ex. 9C | 0.5 | 2.2 | 1.0 | A | 0.001 |
| | 3.0 | 2.0 | 0.9 | | |
| Comp.Ex. 1C | 0.5 | 5.1 | 10.8 | B | 0.8 |
| | 3.0 | 0.7 | 1.3 | | |
| Comp.Ex. 2C | 0.5 | 8.2 | 32.4 | B | 0.9 |
| | 3.0 | 0.8 | 2.0 | | |

Table 3 reveals the following:

(1) Current Density Dependency Test

When using the plating baths of Examples 1C to 9C, the electrodeposited coatings formed at a low current density of 0.5 A/dm$^2$ were substantially equal in Sn/Cu/Bi ratio to those formed at a high current density of 3A/dm$^2$, demonstrating that the Sn/Cu/Bi ratios in the electrodeposited coatings were very low in current density dependency.

In contrast, when using the plating baths of Comparative Examples 1C to 2C which did not contain a sulfur-containing compound, each of the resulting electrodeposited coatings greatly varied in composition, at the high current density and at the low current density. Namely, the composition of these electrodeposited coatings had extremely high dependency on the current density.

(2) Coating Appearance Test

The appearance of the coatings obtained using the plating baths of Examples 1C to 9C were all evaluated as A, whereas the coatings formed using the plating baths of the Comparative Examples were inferior in appearance.

(3) Test for Bath Stability with Time

All of the plating baths of Examples 1C to 9C had an extremely low absorbance, i.e., high transparency with substantially no turbidity. On the other hand, the plating baths of Comparative Examples 1C and 2C had a higher absorbance, meaning that they had higher turbidity than the baths of the Examples.

What is claimed is:

1. A lead-free tin-copper alloy plating bath comprising:

(A) a soluble tin (II) compound;

(B) a soluble copper compound; and (C) at least one sulfur-containing compound selected from the group consisting of the following compounds (i)–(iii):

(i)an aliphatic sulfide compound represented by the following formula (1):

$$Re—Ra—[(X—Rb)_L—(Y—Rc)_M—(Z—Rd)_N]—Rf \quad (1)$$

(wherein the symbols represent the following:

M is an integer of 1–100, L and N are each 0 or an integer of 1–100; Y represents S or S—S, X and Z are the same or different and each represents 0, S or S—S;

Ra represents $C_{1-12}$ straight-chain or branched-chain alkylene or 2-hydroxypropylene;

Rb, Rc and Rd are the same or different and each represents methylene, ethylene, propylene, 2-hydroxy-propylene, butylene, pentylene or hexylene;

in X—Rb, Y—Rc and Z—Rd, the position of each other is not limited and may be randomly positioned, and when the bond X—Rb's, Y—Rc's or Z—Rd's are repeated, the X—Rb's, Y—Rc's or Z—Rd's may be composed of two or more kinds of bonds;

Re and Rf may be the same or different and each represents carboxyl, hydroxyl, —O-alkyl, —S-alkyl, —O-alkenyl, —O-alkynyl, —O-aralkyl, —O-allyl, —O-polycyclic cycloalkyl, —O-acetyl, —O-aryl or —O-polycyclic aryl;

among Re and Rf, the groups other than carboxyl and hydroxyl may be substituted by at least one group selected from the group consisting of halogen, cyano, formyl, alkoxy, carboxyl, acyl, nitro and hydroxyl.), (ii) a sulfide compound (excluding dithiodianiline) having a basic nitrogen atom represented by the following formula (2):

$$Rg—[(S)_X—Rh]p-[(S)_Y—Ri)]q \quad (2)$$

(wherein the symbols represent the following:

X and Y are each an integer of 1–4, p is 0 or an integer of 1–100, q is an integer of 1–100; in which (a) when p=0, Rg and Ri means (1) and (2) below:

(1) Rg and Ri are the same or different and each represents alkyl, alkenyl, alkynyl, aralkyl, cycloalkyl, polycyclic cycloalkyl, aryl, polycyclic aryl, heterocyclic group or polycyclic heterocyclic group, at least one of Rg and Ri having one or more basic nitrogen atom, or (2) Rg and Ri are bonded to each other and form a monocyclic or polycyclic ring having one or more basic nitrogen atom;

in the above (1) and (2), Rg and Ri may be the same or different;

(b) when p is an integer of 1–100, Rg, Rh and Ri mean (1) or (2) below:

(1) Rg and Ri represents alkyl, alkenyl, alkynyl, aralkyl, cycloalkyl, polycyclic cycloalkyl, aryl, polycyclic aryl, heterocyclic group or polycyclic heterocyclic group, Rh represents alkylene, alkenylene, alkynylene, aralkylene, cycloalkylene, polycyclic cycloalkylene, arylene, polycyclic arylene, heterocyclic group or polycyclic heterocyclic group, at least one of Rg, Rh and Ri having one or more basic nitrogen atom, or (2) Rg and Rh, Rg and Ri, or Rh and Ri are bonded, or Rg and Rh, and Rh and Ri are simultaneously bonded, forming a monocyclic or polycyclic ring having one or more basic nitrogen atom;

in the above (1) and (2), Rg, Rh and Ri may be the same or different;

in the above (a) and (b), Rg, Rh and Ri may be substituted by at least one group selected from the group consisting of halogen, amino, cyano, formyl, alkoxy, carboxyl, acyl, nitro and hydroxy.), and (iii) a thiocrown ether compound.

2. The plating bath according to claim 1, wherein the thiocrown ether compound is at least one compound selected from the group consisting of the following (a)–(c):

(a) a thiocrown ether compound having at least one basic nitrogen atom, (b) a thiocrown ether compound having at least one basic nitrogen atom and at least one oxygen atom, (c) a compound in which at least two compounds selected from the group consisting of said thiocrown ether compounds (a) and said thiocrown ether compounds (b) are linked by a $C_1$–$C_5$ alkylene chain.

3. The plating bath according to claim 1 which further comprising at least one compound selected from the group consisting of a compound having two or more nitrogen-containing aromatic rings in a molecule, unsaturated aliphatic carboxylic compound and a surfactant.

4. The plating bath according to claim 3, wherein the surfactant is an alkylene oxide adduct of $C_8$–$C_{30}$ aliphatic amine.

5. A plating method for depositing a tin-copper alloy, the method comprising immersing an article to be plated in the plating bath of claim 1 and forming a tin-copper alloy plated coating by electroplating.

6. A tin-copper-bismuth alloy plating bath comprising:

(A) a soluble tin (II) compound, (B) a soluble copper compound, (C) a soluble bismuth compound, and (D) at least one sulfur-containing compound selected from the group consisting of the following compounds (i)–(iii):

(i) an aliphatic sulfide compound represented by the following formula (1):

$$Re—Ra—[(X—Rb)_L—(Y—Rc)_M—(Z—Rd)_N]—Rf \quad (1)$$

(wherein the symbols represent the following:

M is an integer of 1–100, L and N are each 0 or an integer of 1–100;

Y represents S or S—S, X and Z are the same or different and each represents 0, S or S—S;

Ra represents $C_{1-12}$ straight-chain or branched-chain alkylene or 2-hydroxypropylene;

Rb, Rc and Rd are the same or different and each represents methylene, ethylene, propylene, 2-hydroxy-propylene, butylene, pentylene or hexylene;

the positions of X—Rb, Y—Rc and Z—Rd are not limited and may be randomly positioned, and when the bond X—Rb's, Y—Rc's or Z—Rd's are repeated, the X—Rb's, Y—Rc's or Z—Rd's may be composed of two or more kinds of bonds;

Re and Rf may be the same or different and each represents hydrogen, carboxyl, hydroxyl, alkyl, alkenyl, alkynyl, aralkyl, cycloalkyl, allyl, polycyclic cycloalkyl, aryl, polycyclic aryl, —O-alkyl, —S-alkyl, —O-alkenyl, —O-alkynyl, —O-aralkyl, —O-allyl, —O-polycyclic cycloalkyl, —O-acetyl, —O-aryl or —O-polycyclic aryl;

among Re and Rf, the groups other than hydrogen, carboxyl and hydroxyl may be substituted by at least one group selected from the group consisting of halogen, cyano, formyl, alkoxy, carboxyl, acyl, nitro and hydroxyl.), (ii) a sulfide compound containing a basic nitrogen atom represented by the following formula (2):

$$Rg—[(S)_X—Rh]p-[(S)_Y—Ri)]q \quad (2)$$

(wherein the symbols represent the following:

X and Y are each an integer of 1–4, p is 0 or an integer of 1–100, q is an integer of 1–100; in which (a) when p=0, Rg and Ri means (1) and (2) below:

(1) Rg and Ri are the same or different and each represents alkyl, alkenyl, alkynyl, aralkyl, cycloalkyl, polycyclic cycloalkyl, aryl, polycyclic aryl, heterocyclic group or polycyclic heterocyclic group, at least one of Rg and Ri having one or more basic nitrogen atom, or (2) Rg and Ri are bonded to each other and form a monocyclic or polycyclic ring having one or more basic nitrogen atom;

in the above (1) and (2), Rg and Ri may be the same or different;

(b) when p is an integer of 1–100, Rg, Rh and Ri mean (1) or (2) below:

(1) Rg and Ri represents alkyl, alkenyl, alkynyl, aralkyl, cycloalkyl, polycyclic cycloalkyl, aryl, polycyclic aryl, heterocyclic group or polycyclic heterocyclic group, Rh represents alkylene, alkenylene, alkynylene, aralkylene, cycloalkylene, polycyclic cycloalkylene, arylene, polycyclic arylene, heterocyclic group or polycyclic heterocyclic group, at least one of Rg, Rh and Ri having one or more basic nitrogen atom, or (2) Rg and Rh, Rg and Ri, or Rh and Ri are bonded, or Rg and Rh, and Rh and Ri are simultaneously bonded, forming a monocyclic or polycyclic ring having one or more basic nitrogen atom;

in the above (1) and (2), Rg, Rh and Ri may be the same or different;

in the above (a) and (b), Rg, Rh and Ri may be substituted by at least one group selected from the group consisting of halogen, amino, cyano, formyl, alkoxy, carboxyl, acyl, nitro and hydroxy.), and (iii) a thiocrown ether compound.

7. The plating bath according to claim 6, wherein the thiocrown ether compound is at least one compound selected from the group consisting of the following compounds (a)–(c):

(a) a thiocrown ether compound having at least one basic nitrogen atom, (b) a thiocrown ether compound having at least one basic nitrogen atom and at least one oxygen atom, (c) a compound in which at least two compounds selected from the group consisting of said thiocrown ether compounds (a) and said thiocrown ether compounds (b) are linked by a $C_1$–$C_5$ alkylene chain.

8. The plating bath according to claim 6 which further comprises at least one compound selected from the group consisting of a compound having two or more nitrogen-containing aromatic rings in a molecule, an unsaturated aliphatic carboxylic compound and a surfactant.

9. The plating bath according to claim 8, wherein the surfactant is an alkylene oxide adduct of $C_8$–$C_{30}$ aliphatic amine.

10. A plating method for depositing a tin-copper-bismuth alloy, the method comprising immersing an article to be plated in the plating bath of claim 6 and forming a tin-copper-bismuth alloy plated coating by electroplating.

11. A tin-copper-silver alloy plating bath comprising:

(A) a soluble tin (II) compound;

(B) a soluble copper compound;

(C) a soluble silver compound, and (D) at least one sulfur-containing compound selected from the group consisting of the following compounds (i)–(iii):

(i) an aliphatic sulfide compound (excluding thiodiglycolic acid and thiodiglycol) represented by the following formula:

$$Re—Ra—[(X—Rb)_L—(Y—Rc)_M—(Z—Rd)_N]—Rf \quad (1)$$

(wherein the symbols represent the following:

M is an integer of 1–100, L and N are each 0 or an integer of 1–100;

Y represents S or S—S, X and Z are the same or different and each represents 0, S or S—S;

Ra represents $C_{1-12}$ straight-chain or branched-chain alkylene or 2-hydroxypropylene;

Rb, Rc and Rd are the same or different and each represents methylene, ethylene, propylene, 2-hydroxy-propylene, butylene, pentylene or hexylene;

the positions of X—Rb, Y—Rc and Z—Rd, are not limited and may be randomly positioned, and when the bond X—Rb's, Y—Rc's or Z—Rd's are repeated, the X—Rb's, Y—Rc's or Z—Rd's may be composed of two or more kinds of bonds;

Re and Rf may be the same or different and each represents hydrogen, carboxyl, hydroxyl, alkyl, alkenyl, alkynyl, aralkyl, cycloalkyl, allyl, polycyclic cycloalkyl, aryl, polycyclic aryl, —O-alkyl, —S-alkyl, —O-alkenyl, —O-alkynyl, —O-aralkyl, —O-allyl, —O-polycyclic cycloalkyl, —O-acetyl, —O-aryl or —O-polycyclic aryl;

among Re and Rf, the groups other than hydrogen, carboxyl and hydroxy may be substituted by at least one group selected from the group consisting of halogen, cyano, formyl, alkoxy, carboxyl, acyl, nitro and hydroxy.), (ii) a sulfide compound containing a basic nitrogen atom represented by the following formula (2):

$$Rg—[(S)_X—Rh]_p-[(S)_Y—Ri)]_q \quad (2)$$

(wherein the symbols represent the following:

X and Y are each an integer of 1–4, p is 0 or an integer of 1–100, q is an integer of 1–100; in which (a) when p=0, Rg and Ri means (1) and (2) below:

(1) Rg and Ri are the same or different and each represents alkyl, alkenyl, alkynyl, aralkyl, cycloalkyl, polycyclic cycloalkyl, aryl, polycyclic aryl, heterocyclic group or polycyclic heterocyclic group, at least one of Rg and Ri having one or more basic nitrogen atom, or (2) Rg and Ri are bonded to each other and form a monocyclic or polycyclic ring having one or more basic nitrogen atom;

in the above (1) and (2), Rg and Ri may be the same or different;

(b) when p is an integer of 1–100, Rg, Rh and Ri mean (1) or (2) below:

(1) Rg and Ri represents alkyl, alkenyl, alkynyl, aralkyl, cycloalkyl, polycyclic cycloalkyl, aryl, polycyclic aryl, heterocyclic group or polycyclic heterocyclic group, Rh represents alkylene, alkenylene, alkynylene, aralkylene, cycloalkylene, polycyclic cycloalkylene, arylene, polycyclic arylene, heterocyclic group or polycyclic heterocyclic group, at least one of Rg, Rh and Ri having one or more basic nitrogen atom, or (2) Rg and Rh, Rg and Ri, or Rh and Ri are bonded, or Rg and Rh, and Rh and Ri are simultaneously bonded, forming a monocyclic or polycyclic ring having one or more basic nitrogen atom;

in the above (1) and (2), Rg, Rh and Ri may be the same or different;

in the above (a) and (b), Rg, Rh and Ri may be substituted by at least one group selected from the group consisting of halogen, amino, cyano, formyl, alkoxy, carboxyl, acyl, nitro and hydroxy), and (iii) a thiocrown ether compound.

12. The plating bath according to claim 11, wherein the thiocrown ether compound is at least one compound selected from the group consisting of the following (a)–(c):

(a) a thiocrown ether compound having at least one basic nitrogen atom, (b) a thiocrown ether compound having at least one basic nitrogen atom and at least one oxygen atom, (c) a compound in which at least two compounds selected from the group consisting of said thiocrown ether compounds (a) and said thiocrown ether compounds (b) are linked by a $C_1$–$C_5$ alkylene chain.

13. The plating bath according to claim 11 which further comprises at least one compound selected from the group consisting of a compound having two or more nitrogen-containing aromatic rings in a molecule, an unsaturated aliphatic carboxylic compound and a surfactant.

14. The plating bath according to claim 13, wherein the surfactant is an alkylene oxide adduct of $C_8$–$C_{30}$ aliphatic amine.

15. A plating method for depositing a tin-copper-silver alloy, the method comprising immersing an article to be plated in the plating bath of claim 11 and forming a tin-copper-silver alloy plated coating by electroplating.

* * * * *